US010830465B2

(12) United States Patent
Singh et al.

(10) Patent No.: US 10,830,465 B2
(45) Date of Patent: Nov. 10, 2020

(54) INTEGRATED VENTILATION AND ILLUMINATION SYSTEM

(71) Applicant: Broan-NuTone LLC, Hartford, WI (US)

(72) Inventors: Eshank Singh, New Dehli (IN); Bernard J. Krauska, Hartford, WI (US); Lauren Weigel, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 16/722,968

(22) Filed: Dec. 20, 2019

(65) Prior Publication Data

US 2020/0200412 A1 Jun. 25, 2020

Related U.S. Application Data

(60) Provisional application No. 62/782,700, filed on Dec. 20, 2018.

(51) Int. Cl.

| | |
|---|---|
| ***F24F 7/10*** | (2006.01) |
| ***F21V 21/04*** | (2006.01) |
| ***F21S 8/04*** | (2006.01) |

(52) U.S. Cl.

CPC ..... *F24F 7/10* (2013.01); *F21S 8/043* (2013.01); *F21V 21/04* (2013.01); *F24F 2221/02* (2013.01); *F24F 2221/14* (2013.01)

(58) Field of Classification Search

CPC ..... F24F 7/10; F24F 2221/02; F24F 2221/14; F21S 8/02; F21S 8/03; F21S 8/04; F21S 8/043; F21V 33/0096; F21V 29/67; F21V 21/04

See application file for complete search history.

(56) References Cited

U.S. PATENT DOCUMENTS

| | | | | |
|---|---|---|---|---|
| 5,664,872 | A * | 9/1997 | Spearman | F21V 33/0096 362/96 |
| 8,967,832 | B2 * | 3/2015 | Zakula | F24F 13/078 362/294 |
| 2018/0045204 | A1 * | 2/2018 | Van Grootheest | F04D 25/088 |

(Continued)

*Primary Examiner* — Alan B Cariaso

(74) *Attorney, Agent, or Firm* — Barnes & Thornburg LLP

(57) ABSTRACT

An integrated ventilation and illumination system includes a ventilation assembly, a light fixture assembly, and an adaptor. In an installed position, the ventilation assembly is installed in a ceiling of a room of building structure to provide ventilation for the room and the light fixture assembly is mounted in a low-profile configuration relative to the ceiling. The adaptor spans and obscures an inlet opening of the ventilation assembly and includes at least one opening that allows for the passage of air through both the adaptor and into the inlet opening. A mounting bracket is coupled to both the adaptor and the light fixture assembly in the installed position, where the fixture is offset a first critical distance from the adaptor to define an air flow gap that allows for air flow around the light fixture assembly, through the opening in the adaptor and into the internal region of the main housing. The first critical distance is purposely sized according to operating parameters of the blower of the ventilation assembly to provide a sufficient flow rate of intake air and acceptable sound levels during operation of the ventilation and illumination system.

20 Claims, 24 Drawing Sheets

(56) References Cited

U.S. PATENT DOCUMENTS

| | | | | |
|---|---|---|---|---|
| 2018/0066838 | A1* | 3/2018 | Huang | F04D 25/088 |
| 2019/0145652 | A1* | 5/2019 | Sinur | F21S 8/06<br>454/294 |
| 2019/0277521 | A1* | 9/2019 | Lee | F24F 7/10 |

* cited by examiner

INTEGRATED VENTILATION AND ILLUMINATION SYSTEM

PRIORITY CLAIM

This application claims priority to U.S. Provisional Patent Application No. 62/782,700, filed Dec. 20, 2018, which is incorporated by reference herein in its entirety.

TECHNICAL FIELD

The present disclosure relates generally to an integrated ventilation and illumination system that is installed in a ceiling of a room and that couples an exhaust fan with a light fixture. In an installed position, an air flow cavity is defined between the light fixture and the ceiling to which the system is installed, where the cavity allows for air flow around the light fixture, through an adaptor that both affixes the light fixture to the exhaust fan and that spans and obscures a ceiling aperture, and into an internal region of the exhaust fan for eventual exhaust.

BACKGROUND

Conventional ventilation exhaust fans, such as those typically installed in a room of a building structure, such as a bathroom, draw air from within an area of the room, through the fan and exhaust the air to another location, such as through a vent in the gable or roof of a home or other building structure. Many conventional ventilation exhaust fan assemblies include a housing positioned within or adjacent an aperture formed in a wall or ceiling. Some conventional exhaust fans also include a lighting element, such as a light bulb operably connected within a socket in the housing to provide illumination within the room. However, the light bulb is visible to observers standing within the room. A shroud may be positioned with the housing to substantially or entirely obscure the socket. In some cases, it may be desirable to replace the light bulb with a more aesthetically pleasing light fixture while still providing the ventilation function of the fan. It also may be desirable to replace the single light bulb with a light fixture that provides a greater amount of illumination, e.g., more lumens, than that provided by the light bulb. However, conventional light fixtures that are affixed to housing can impede and/or restrict the flow air through the fan and as a result, the performance of the fan is compromised.

Therefore, a need exists for an integrated ventilation and illumination system that accommodates installation of a light fixture and provides a sufficient amount of ventilation for the room of the building structure. A full discussion of the features and advantages of the present disclosure is deferred to the following detailed description, which proceeds with reference to the accompanying drawings.

The description provided in the background section should not be assumed to be prior art merely because it is mentioned in or associated with the background section. The background section may include information that describes one or more aspects of the subject technology.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

Figure 1:
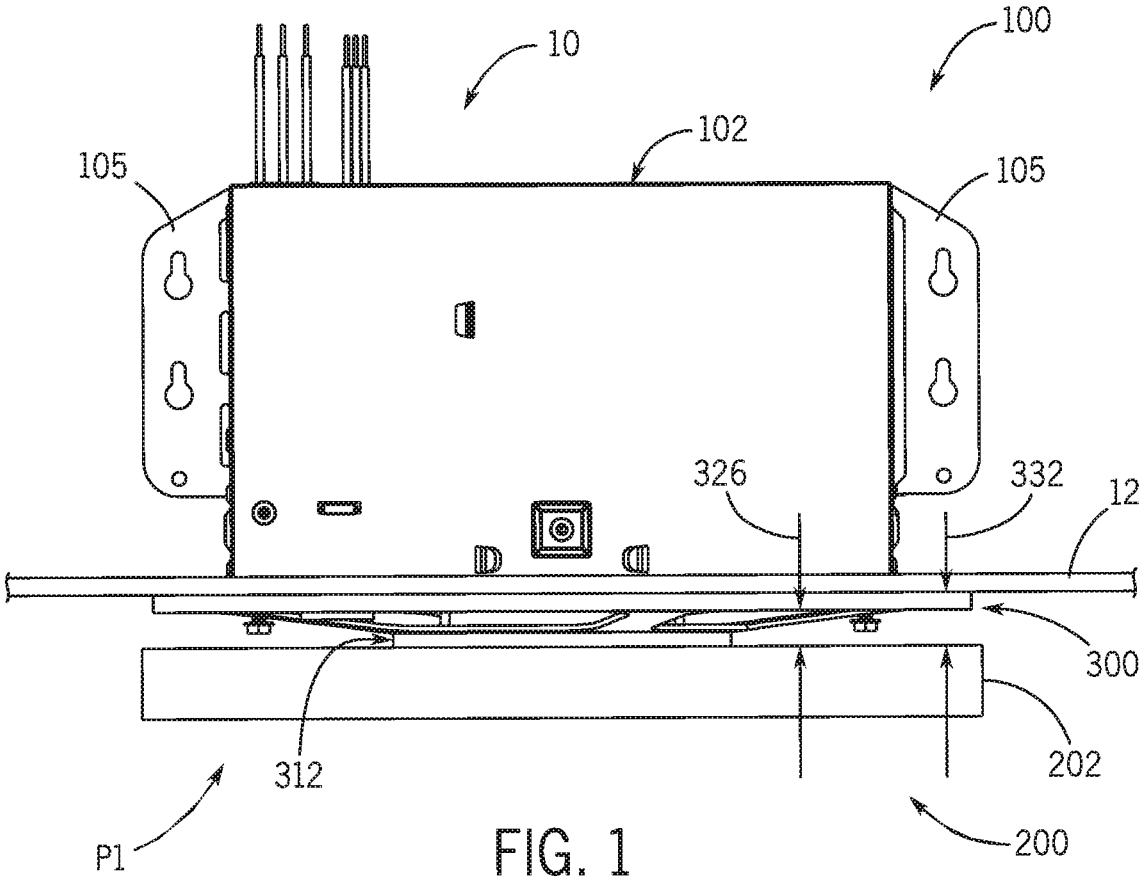
FIG. 1 is a side view of an exemplary embodiment of an integrated ventilation and illumination system in accordance with the present disclosure in an installed position relative to a ceiling, where the system includes a ventilation assembly, a light fixture assembly, and an adaptor arranged to couple the light fixture assembly to the ventilation assembly.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

Referring to FIGS. 1-22, an integrated ventilation and illumination system constructed in accordance with an exemplary embodiment of the present disclosure is shown generally at 10. The ventilation and illumination system 10 comprises several components and devices which perform various functions, as described below. The ventilation and illumination system 10 includes a ventilation assembly 100, a light fixture assembly 200, 1200, 2200 shown here in a "luminaire" configuration, and an adaptor 300, 400, 500, 600, 700, 800 that affixes the light fixture assembly 200, 1200, 2200 to the ventilation assembly 100. A mounting bracket 312, 412 is provided to couple the light fixture 202, 1202 to the adaptor 300, 400, 500, 600, 700, 800, 900. In an installed position P1 of FIGS. 1, 11, 12A, 13, 15 and 17, the integrated ventilation and illumination system 10 is installed above a ceiling 12 of a room or building structure (e.g., a residence or workplace). The adaptor 300, 400, 500, 600, 700, 800, 900 couples the light fixture assembly 200, 1200, 2200 to the ventilation assembly 100 to secure the light fixture assembly 200, 1200, 2200 below the ceiling 12 in a low-profile mounting configuration relative to the ceiling 12. The low-profile mounting configuration provides an aesthetically pleasing appearance for the light fixture assembly 200, 1200, 2200 and is thus advantageous for the system 10, as opposed to cumbersome, visually obtrusive conventional mounting configurations that do not allow for low-profile mounting and thereby cause the light fixture assembly 200, 1200, 2200 to extend further downward into the room relative to the ceiling 12.

The adaptor 300, 400, 500, 600, 700, 800, 900 covers, underlies and spans both an inlet opening 108 formed in a housing 102 of the ventilation assembly 100 and a ceiling aperture 12*a* to obscure them from view by a person standing in the room in which the system 10 is installed. The adaptor 300, 400, 500, 600, 700, 800, 900 is positioned vertically below the housing inlet opening 108 and the ceiling aperture 12*a*, hence the adaptor 300, 400, 500, 600, 700, 800, 900 underlies the housing inlet opening 108 and the ceiling aperture 12*a*. In the embodiments shown in the Figures, the adaptor 300, 400, 500, 600, 700, 800, 900 has a greater exterior dimension than the exterior dimension of each of the housing inlet opening 108 and the ceiling aperture 12*a*, thus the adaptor 300, 400, 500, 600, 700, 800, 900 spans and overlaps the housing inlet opening 108 and the ceiling aperture 12*a* to prevent them from being viewed in the in the installed position P1. Also in the installed position P1, an air flow gap 302 is defined between the light fixture 202, 1202 and the ceiling 12, where the gap 302 is purposely sized and configured to allow for a sufficient quantity of air flow F (see FIGS. 3 and 5) around the light fixture 202, 1202 and into the ventilation assembly 100 for eventual exhaust beyond the room in which the system 10 is installed. In some instances, common disclosure for the system 10, including the light fixture assemblies 200, 1200, 2200 and the adaptor 300, 400, 500, 600, 700, 800, 900 is not be repeated below, but it should be understood that across embodiments like references numbers are applicable to like structures and components. For example, the disclosure relating to the light fixture assembly 200 applies in equal force to the light fixture assembly 1200, 2200. Moreover, it is to be understood that any one or more features of one version of the ventilation and illumination system 10, including the inventive adaptor 300, 400, 500, 600, 700, 800, 900 can be used in conjunction with the other versions of the inventive adaptor 300, 400, 500, 600, 700, 800, 900.

The system 10 can be manufactured, marketed and sold with the ventilation assembly 100, the adaptor 300, 400, 500, 600, 700, 800, 900 and the light fixture assembly 200, 1200, 2200 to provide both ventilation and lighting features. Alternatively, the system 10 is manufactured, marketed and sold with the ventilation assembly 100 and the adaptor 300, 400, 500, 600, 700, 800, 900 but omitting the light fixture assembly 200, 1200, 2200, however, a separate light fixture assembly can be coupled to the system 10. In this manner, the system 10 functions as a flexible platform to accommodate other existing light fixtures and to provide an aesthetic system with both ventilation and illumination functionalities.

Figure 2:
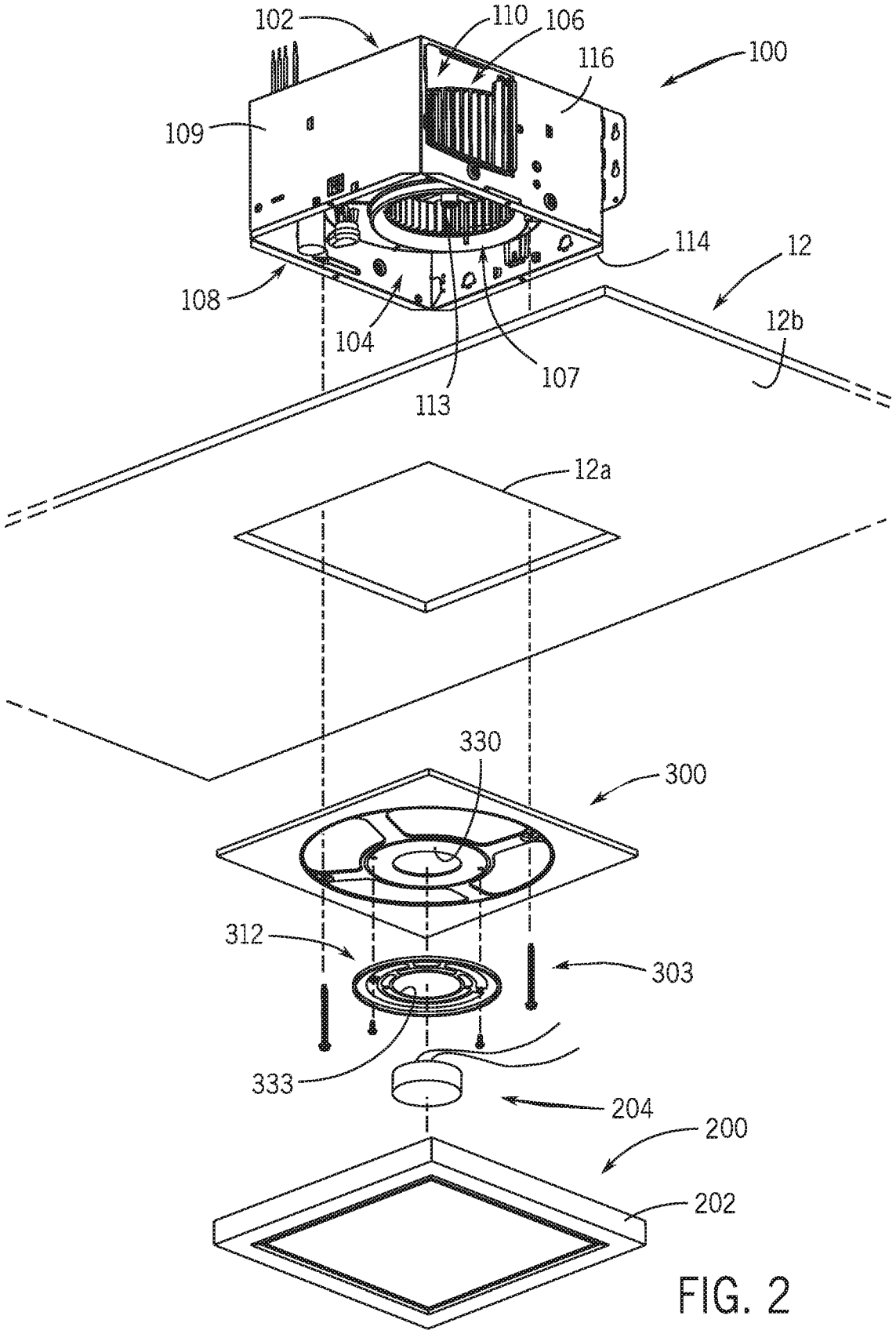
FIG. 2 is an exploded view of the ventilation and illumination system of FIG. 1 relative to the ceiling.

A first embodiment of the system 10 including an adaptor 300 is shown in FIGS. 1-4D. As shown in FIGS. 1 and 2, the ventilation assembly 100 includes a main housing 102 defining an internal region 104 and a blower assembly 106 residing within the internal region 104. The blower assembly 106 includes a motor 113 and an impeller or wheel 107 operably connected to the motor 113 and residing within an internal scroll. During operation of the blower assembly 106, the impeller 107 rotates about a central axis and draws air from the room into the housing 102.

Figure 3:
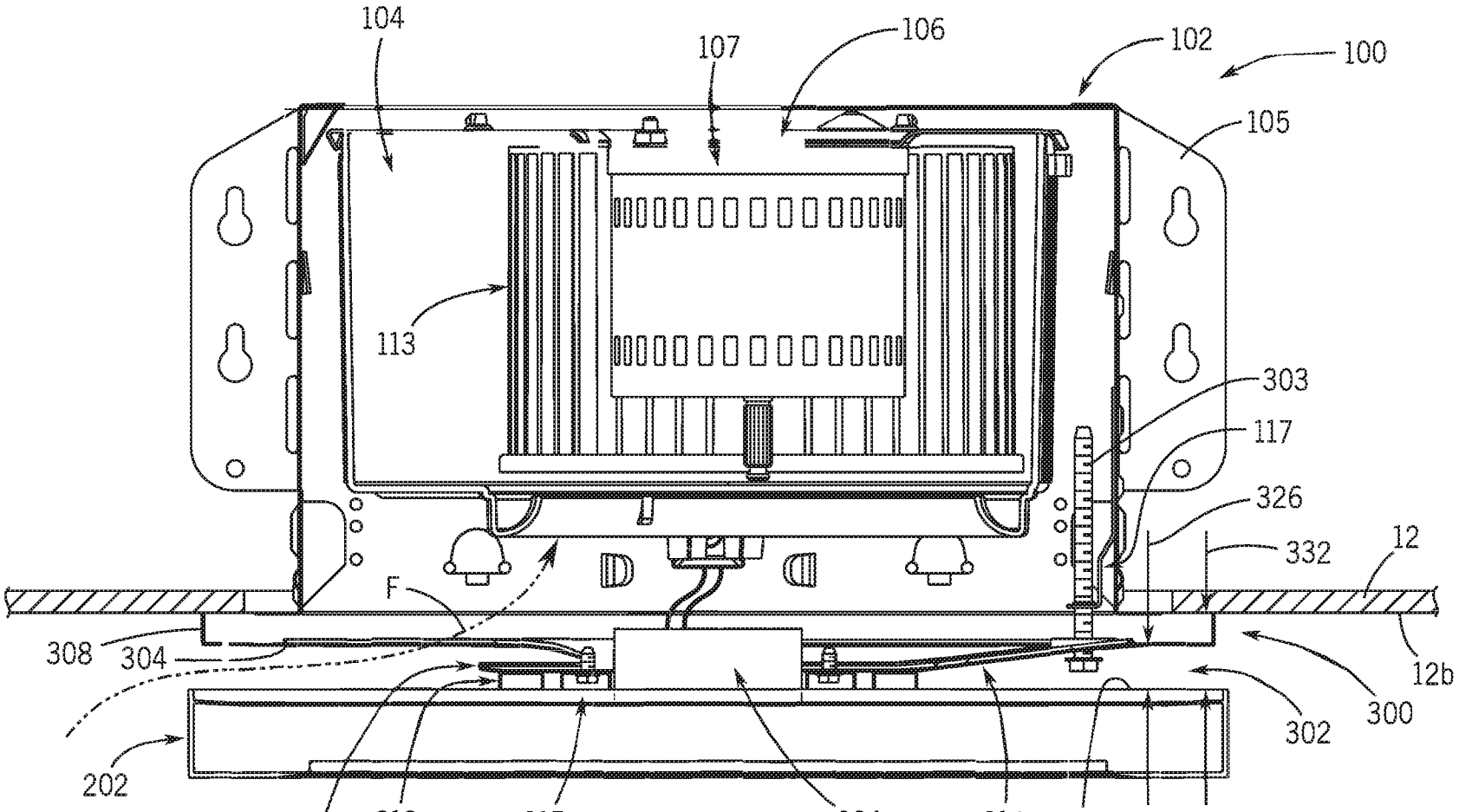
FIG. 3 is a side view of the ventilation and illumination system of FIG. 1 installed above the ceiling with a side wall of the housing removed and arrows indicating both a first critical dimension and a second critical dimension provided by the adaptor between the light fixture assembly and the ceiling.

Referring to FIGS. 1-3, the main housing 102 includes at least one bracket 105 adapted to secure the ventilation and illumination system 10 to the building structure to position the system 10 relative to a room to be ventilated and/or illuminated. The housing bracket 105 may be shaped and sized to mate with ceiling structure, such as joist or support member of the building structure. The main housing 102 also includes an external wall arrangement 109 comprised of a plurality of housing walls that define the internal region 104 as shown in FIGS. 1 and 3. The internal region 104 houses various components of the system 10 including the blower 106 and one or more electrical connections and a controller for the system 10. The main housing 102 also includes an inlet air opening 108 and an outlet or discharge air opening 110. In the embodiment of FIG. 1, the inlet opening 108 is cooperatively dimensioned to align with an aperture 12*a* formed in the ceiling 12 of the room of the building structure. A peripheral flange 114 (see FIG. 2) extends outwardly away from the external wall arrangement 109. The peripheral flange 114 is sized to receive a surface 12*b* of the ceiling 12 immediately adjacent to the aperture 12*a*. The outlet air opening 110 is formed in a side wall 116 of the external wall arrangement 109 and directs discharge air toward a space outside of the internal region 104. In some embodiments, the outlet opening 110 may be fluidly coupled to a duct leading to a vent that discharges into the atmosphere outside of the building structure.

The main housing 102 can be formed of any material known to those skilled in the art capable of withstanding varying temperatures, namely to withstand any heat radiated and/or conducted from the lamp, motor and/or other components while providing structural integrity to the system 10. In some embodiments, the main housing 102 is formed of sheet metal, but could instead be formed of a ceramic or a polymer having a relatively high melting temperature and/or glass transition temperature. The main housing 102 can have any shape, including a box-like or cubical shape, a hemi-spherical shape, a spherical shape, a pyramidal shape, and the like. The main housing 102 can form a base or frame for the ventilation and illumination system 10, thereby providing points and areas of attachment for other components of the ventilation and illumination system 10. As shown in FIGS. 1-4 for example, the main housing 102 can provide places of attachment for various components such as the blower assembly 106 and the adaptor 300.

In one embodiment, the blower assembly 106 is a centrifugal fan including the motor and the impeller 107, as is well-known to those skilled in the art. However, other types of blower assemblies can be employed as desired provided they do not interfere with the structure and operation of the adaptor 300. Illustratively, the blower assembly 106 is located entirely within the main housing 102, however in other embodiments, the blower 106 can be in fluid communication with the main housing 102 via one or more ducts coupled to the main housing 102. In yet another embodiment, the internal region may include multiple sub-cavities and the blower 106 may be located in only one of the sub-cavities.

The light-fixture assembly 200, configured as a "luminaire" in the Figures, includes a light fixture 202, a lighting element (e.g. at least one light emitting diode (LED)) and a power supply or driver 204 that supplies power to the lighting element, as shown in FIGS. 2 and 3. The light fixture 202 may be square (see FIGS. 1-12B), rectangular, circular (see FIGS. 13-17C), or any other suitable shape. Depending on the shape of the light fixture 202, the adaptor 300 is configured to complement the light fixture 202 as will be described in greater detail below. The power supply 204 includes external leads or wires 205 for connection to a power source, and is coupled to an upper surface 208 of the light fixture 202 in a generally central region of the upper surface 208.

The adaptor 300 operably connects the light fixture assembly 200 to the ventilation assembly 100 as shown in FIGS. 1, 3, 10 and 11. Since the adaptor 300 has a greater exterior dimension (e.g., perimeter) than the exterior dimension of each of the housing inlet opening 108 and the ceiling aperture 12*a* (e.g., their respective perimeters), the adaptor 300 spans, overlaps and underlies the inlet opening 108 of the housing 102 and the ceiling aperture 12*a* to obscure them from view to arrive at the installed position P1. In this manner, a flange 308 of the adaptor 300 is positioned outward and beyond the periphery of the inlet opening 108 and the ceiling aperture 12*a*. The adaptor 300 provides means for mounting the light fixture 202 to the ventilation system 100 to provide the system 10 with both ventilation and illumination functionality. The light fixture assembly 200 and the adaptor 300 could be provided as original equipment or retrofit for a pre-existing ventilation system. For example, the light fixture assembly 200 and the adaptor 300 could be provided as a retrofit or replacement assembly for a pre-existing ventilation system that may lack a lighting component. Although this disclosure shows the light fixture assembly 200 and the adaptor 300 in conjunction with the ventilation assembly 100, namely the main housing 102, the light fixture assembly 200 and the adaptor 300 may be installed in a ventilation system that lacks a local main housing 102 with a blower 106. For example, the light fixture assembly 200 and the adaptor 300 could be installed to a duct inlet in a room where the duct is part of a ventilation system (e.g. fresh air system or HVAC system) having a central blower that is located remote from the particular light fixture assembly 200 and the adaptor 300. This remote central blower also provides for air flow F around the light fixture assembly 200, through the adaptor 300 and into the duct inlet.

The adaptor 300 is configured to mount a square or rectangular light fixture 202 to the ventilation assembly 100. The adaptor 300 has a corresponding square or rectangular shape to provide for greater aesthetics for the system 10. As shown in FIG. 3, the adaptor 300 is configured to provide the required air flow gap 302 between the ventilation assembly 100 and the light fixture assembly 200 such that the required air flow F travels around the light fixture assembly 200, through the adaptor 300, and into the housing 102. The adaptor 300 may have a variety of features to provide the air flow gap 302 between the ventilation assembly 100 and the light fixture assembly 200. As shown in FIGS. 3-4D, the adaptor 300 includes a peripheral region 304 and a central region 306 at least partially offset from the peripheral region 304 to define the air flow gap 302 between the ceiling 12 and the light fixture assembly 200. The peripheral region 304 has an outermost dimension that is greater than an outermost dimension of the inlet opening 108, the peripheral flange 114 and the aperture 12*a* in ceiling 12. The peripheral region 304 blocks visibility of the aperture 12*a* from the room in which the system 10 is connected. The central region 306 has an outermost dimension that is less than the outermost dimension of the peripheral region 304 and the outermost dimension of the housing 102

A plurality of arms 314 extend from the peripheral region 304 and the central region 306. Specifically, the arms 314 extend from an inner edge 316 of the peripheral region 304 and converge at an outer edge 318 of the central region 306. The plurality of arms 314 are angled relative to the peripheral region 304 and the central region 306 to provide a vertical offset between the peripheral region 304 and the central region 306, as shown in at least FIG. 4D. As a result, the adaptor has an overall height of at least 0.5 inch, and preferably 0.75 inch, that ensures the first critical distance 326 without creating a first critical distance 326 that would provide an unappealing aesthetic appearance for the system 10. At least one arm 314 includes an aperture 314*a* that may be positioned within a recessed cavity and that receives a fastener 303 to couple the adaptor 300 to the housing 102. At least one opening 305 is formed between the peripheral region 304 and the central region 306 that allows air flow F to pass through the adaptor 300 and into the internal region 104 of the housing 102. Each of the openings 305 are separated from one another by an arm 314. In the illustrative embodiment, each opening has an area between about 30 $in^2$ to about 40 $in^2$. The area of the openings 305 insures an adequate air flow rate through the adaptor 300 and into the internal region 104 while accounting for the system 10's operating parameters, including the type of blower 106 in the main housing 102, the size of the inlet opening 108, and/or the size of the light fixture 202 used.

Figure 4A:
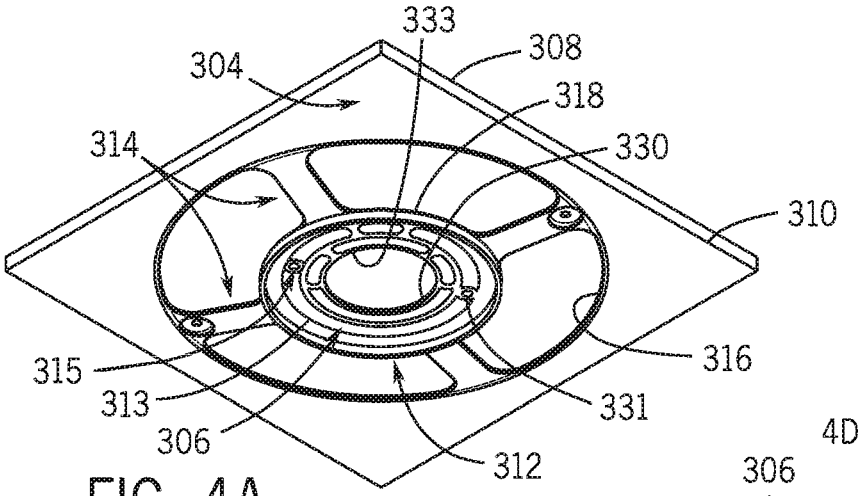
FIG. 4A is a bottom perspective view of the adaptor of FIG. 1, showing a mounting bracket affixed to the adaptor.
Figure 4B:
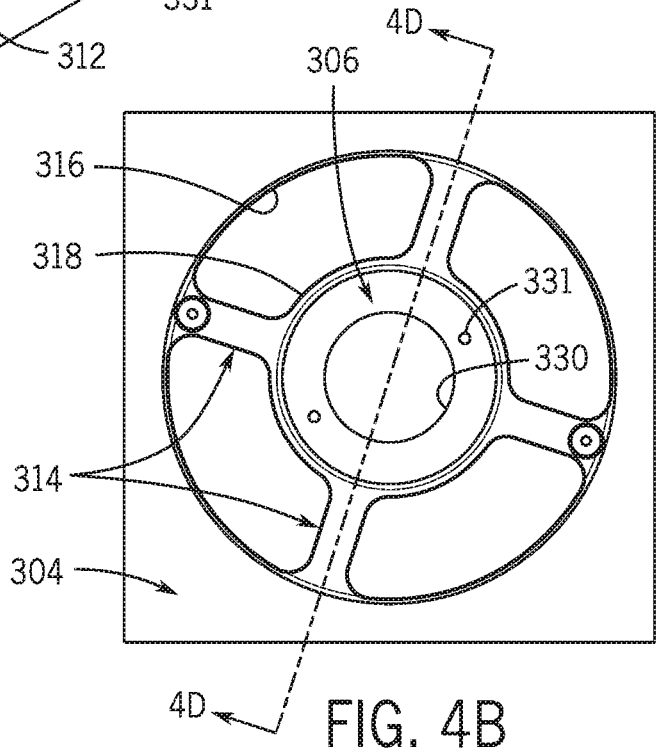
FIG. 4B is a bottom view of the adaptor of FIG. 1 without the mounting bracket of FIG. 4A.
Figure 4C:
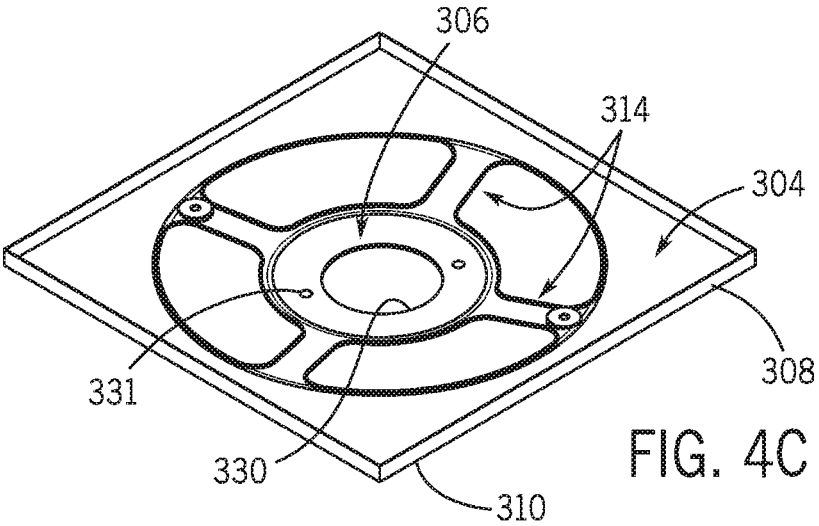
FIG. 4C is a top perspective view of the adaptor of FIG. 1.
Figure 4D:
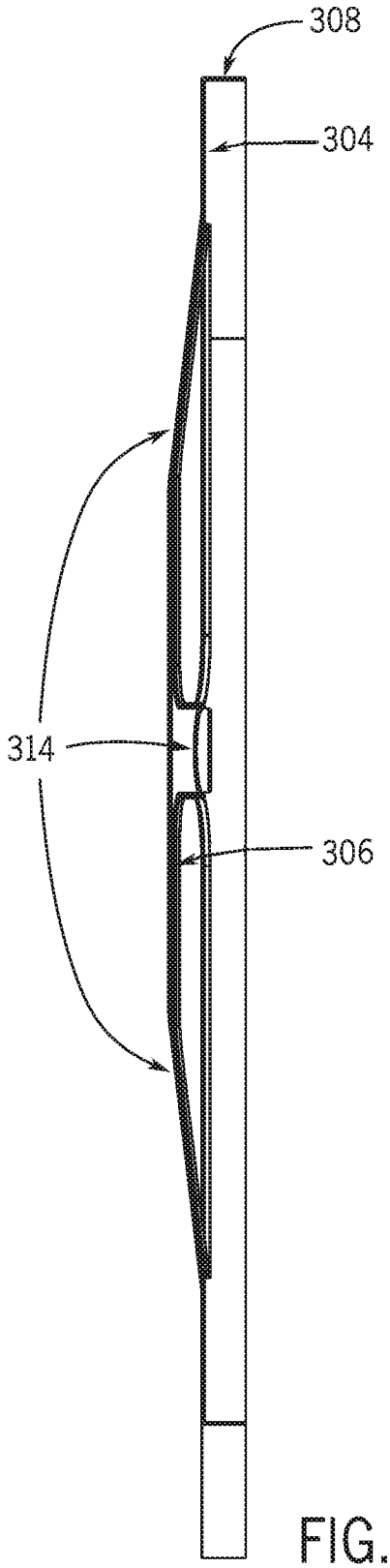
FIG. 4D is a cross sectional view of the adaptor of FIG. 1 taken along line 4D-4D in FIG. 4B.

The central region 306 of the adaptor 300 includes a central aperture 330 and a plurality of mount holes 331 as shown in FIGS. 4A and 4C. The central aperture 330 is sized to receive at least an extent of the power supply 204 as shown in FIG. 3, which helps ensure the low-profile mounting configuration of the light fixture 202 relative to the ceiling 12, while maintaining the first critical distance 326 and the second critical distance 332. With the power supply 204 mounted above the light fixture 202 and received in the central aperture 330, as opposed to within the light fixture 202, durability and useful life of the power supply 204 is increased because the operating temperature of the power supply 204 is reduced during operation of the system 10 due to the ventilation of heat generated by the power supply 204 that the system 10 provides. Referring to FIG. 4A, the mounting bracket 312 is configured to couple to the central region 306 to mount the light fixture 202 to the adaptor 300. The mounting bracket 312 shown in FIG. 4A is circular and includes a plurality of slots 313 sized to receive fasteners 315. The fasteners 315 extend through the slots 313 and into the mount holes 331 formed in the central region 306 to couple the mounting bracket 312 to the adaptor 300. The mounting bracket 312 includes a central aperture 333 that is generally concentric with the central opening 330 formed in the central region 306 of the adaptor 300. The central aperture 333 is sized to receive at least an extent of the power supply 204 when the light fixture 200 is fully installed. Alternatively, the mounting bracket 312 is omitted and the adaptor 300 is configured to receive at least one fastening mechanism to secure the light fixture 202 to the adaptor 300 and still attain both the first critical distance 326 and the airflow gap 302.

The adaptor 300 further includes the peripheral flange 308 that extends around a perimeter 310 of the peripheral region 304 as shown in FIGS. 3 and 4A-4D. The peripheral flange 308 extends upwardly and away from the peripheral region 304 and is positioned to contact the lower ceiling surface 12*b* to ensure that the adaptor 300 and the light fixture assembly 200 are parallel with the ceiling 12 in the installed position, as discussed below. In some embodiments, the peripheral flange 308 may be omitted such that an upper surface of the peripheral region 304 contacts the lower ceiling surface 12*b*.

As shown in FIGS. 3 and 4D, the central region 306 of the adaptor 300 is offset downward from the peripheral region 304 to provide a first critical distance 326 defined the peripheral region 304 and the upper surface 208 of the light fixture 202. The first critical distance 326 is largely a function of the shape of the arms 314 as they extend at an angle from the peripheral region 304 to the central region 306. The first critical distance 326 defines the airflow gap 302 that allows the air flow F to vent from the room, around the light fixture assembly 200, through the adaptor 300 and into the housing 102. A second critical distance 332 is defined between the lower surface 12*b* of the ceiling 12 and the upper surface 208 of the light fixture 202. The peripheral flange 308 cooperates with the plurality of arms 314 to define the second critical distance 332. The first and second critical distances 326, 332 provide a vertical dimension of the air flow gap 302, at their respective locations. In the illustrative embodiment, the second critical distance 332 is slightly larger than the first critical distance 326, due to the vertical offset between the peripheral region 304 and the ceiling 12 created by the peripheral flange 308.

The first critical distance 326 is predetermined, for instance by the engineer, developer or manufacturer of the system 10, according to the system's operating parameters, namely the blower 106, to ensure an adequate flow rate of air into the main housing 102 and to provide acceptable sound or loudness levels during operation of the system 10. In the illustrative embodiment, the blower 106 is configured to provide a flowrate of about 110 cubic feet per minute (CFM) and a sound or loudness level of about 1.5 Sones. Based upon those specifications, the first critical distance 326 is determined to be about ⅜ inch. Alternatively, the first critical distance 326 is approximately 1 inch or less, and may be within a range of ¼ to 1 inch. Usage of the adaptor 300 ensures that the required first critical distance 326 and the air flow gap 302 occur in the installed position P1 whereby a sufficient amount of air is drawn through the air flow gap 302, through the adaptor 300 and into the housing 102 during operation of the system 10. If the first critical distance 326 is reduced below the predetermined amount, and the air flow gap 302 is too restrictive and as a result, an insufficient amount of air may be drawn through the air flow gap 302 and into the housing 102. This condition will reduce the operating performance (e.g., reduced air flow F, vibration and/or noise), efficiency and operating life of the blower assembly 106, which in turn reduces the performance of the system 10.

Figure 6D:
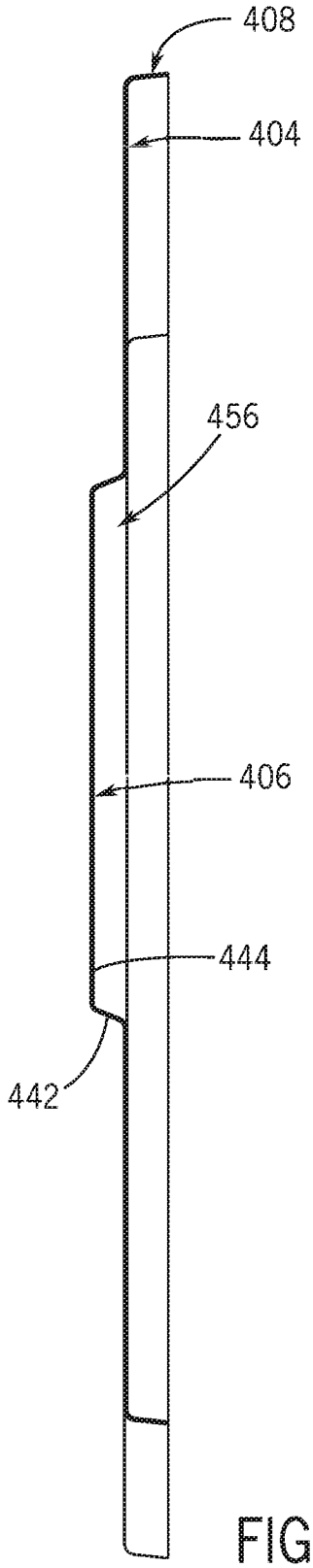
FIG. 6D is a cross sectional view of the adaptor of FIG. 5 taken along line 6D-6D in FIG. 6B.
Figure 5:
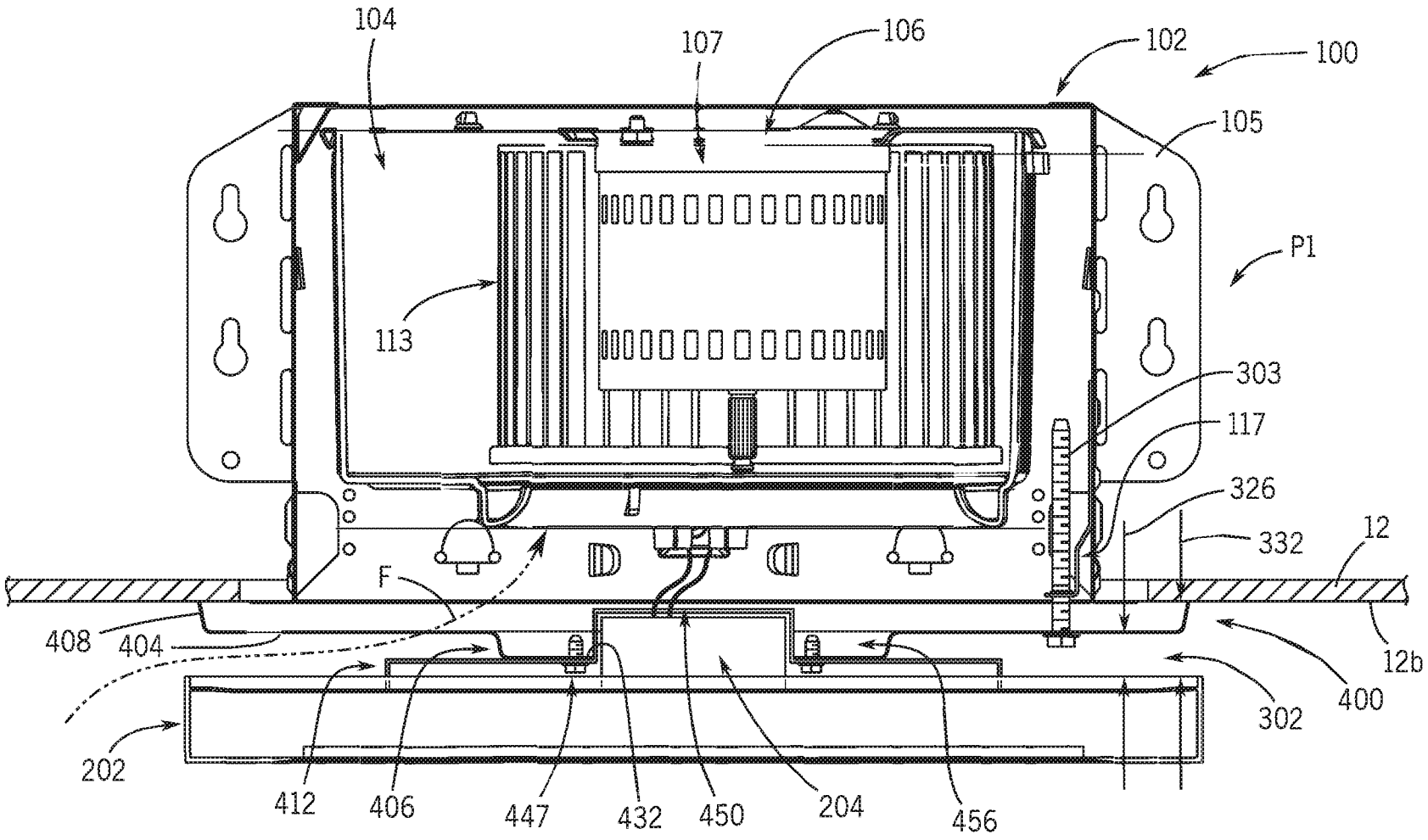
FIG. 5 is a side elevation view of a second embodiment of an integrated ventilation and illumination system in the installed position showing an alternate adaptor coupled between the ventilation assembly and a light fixture assembly and arrows indicating both a first critical dimension and a second critical dimension provided by the adaptor between the light fixture assembly and the ceiling.

FIGS. 5-6D illustrate a second embodiment of an adaptor 400 with alternative structures to provide the first critical distance 326. As shown in FIGS. 6A-D, the adaptor 400 includes a peripheral region 404 and a central region 406 that is at least partially offset from the peripheral region 404. The adaptor 400 also includes a peripheral flange 408 that is substantially similar to peripheral flange 308. A plurality of arms 414 extend between the peripheral region 404 and the central region 406. Specifically, the arms 414 extend from an inner edge 416 of the peripheral region 404 and converge at an outer edge 418 of the central region 406. The plurality of arms 414 are coplanar with the peripheral region 404. A plurality of openings 405 are formed between the peripheral region 404 and the central region 406 to allow for air to flow around the light fixture 202 through the openings 405 and into the internal region 104 of the housing 102. Each arm 414 separates the openings 405 from one another. At least one arm 414 includes an aperture 414*a* that may be positioned within a recessed cavity and that receives a fastener 303 to couple the adaptor 400 to the housing 102.

Figure 6A:
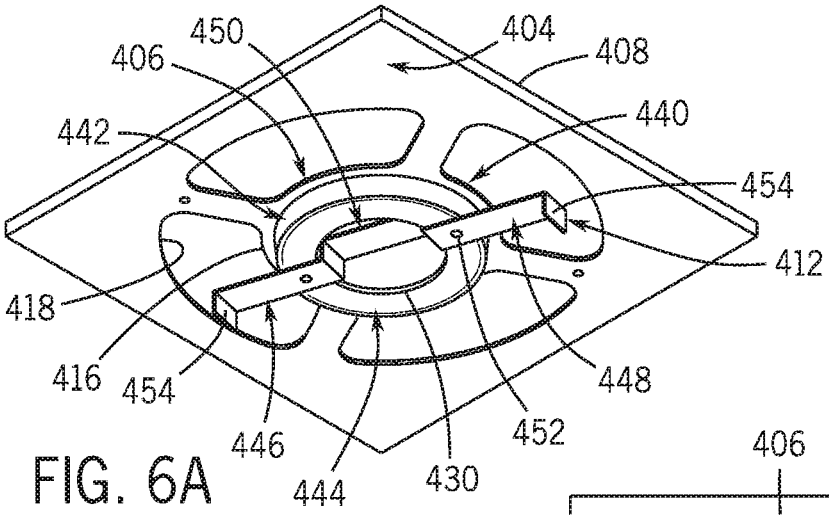
FIG. 6A is a bottom perspective view of the adaptor of FIG. 5, showing a mounting bracket affixed to the adaptor.
Figure 6B:
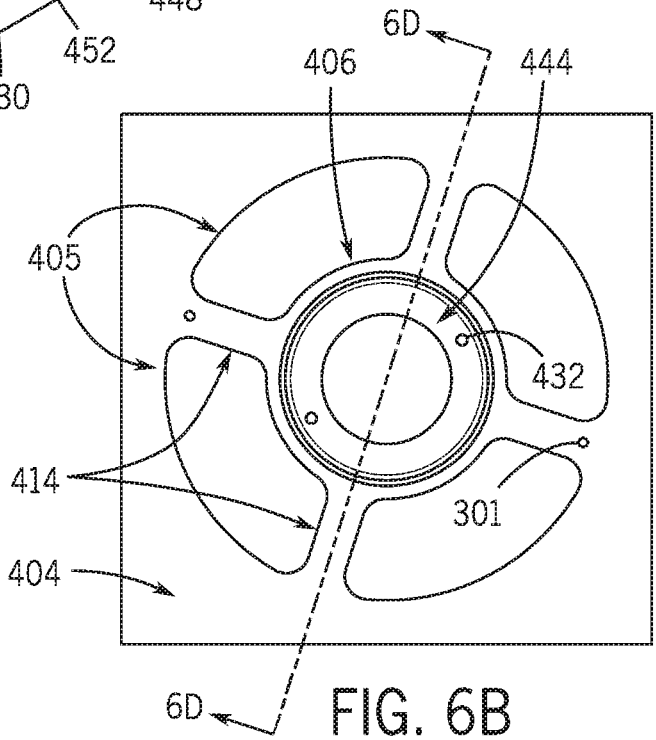
FIG. 6B is a bottom view of the adaptor of FIG. 5 without the mounting bracket of FIG. 6A.
Figure 6C:
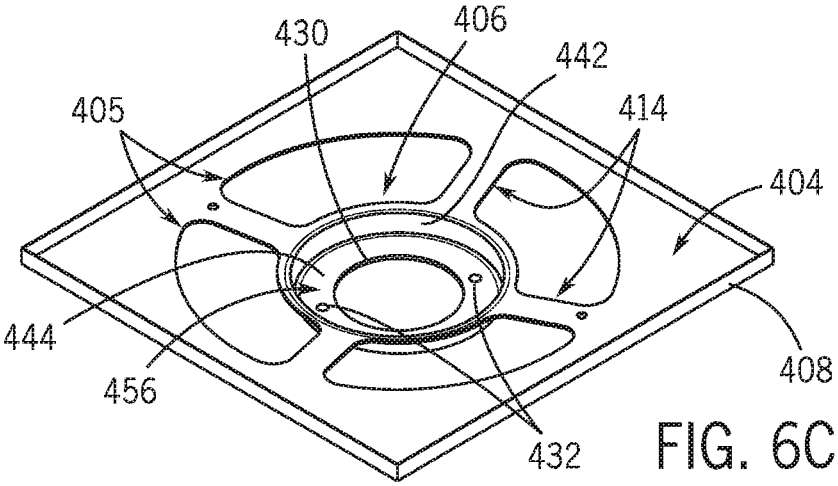
FIG. 6C is a top perspective view of the adaptor of FIG. 5.

The central region 406 includes an upper flange 440 that provides the outer edge 418 to which each arm 414 is coupled as shown in FIGS. 6A-6C. The central region 406 further includes a depending side wall 442 that extends downwardly away from the upper flange 440 to provide the first critical distance 326. A lower end wall 444 extends across a lower extent of the depending side wall 442 and is substantially parallel with the upper flange 440. As a result, the adaptor 400 has an overall height from the peripheral region 406 to the lower end wall 444 of at least 0.5 inch, and preferably 0.75 inch, that ensures the first critical distance 326 without creating a first critical distance 326 that would provide an unappealing aesthetic appearance for the system 10. The lower end wall 444 is configured to couple with a mounting bracket 412 to secure the light fixture 202 to the adaptor 400. The mounting bracket 412 is illustratively embodied as an elongated and staggered member or bar that includes a pair of side extensions 446, 448 and a staggered central segment 450 that forms a receptacle, as shown in FIGS. 6A-6C. The side extensions 446, 448 extend laterally outward from the central segment 450 and each includes a mount hole 452 and an attachment flange 454. The mount holes 452 are configured to receive fasteners 447 (see FIG. 5) that extend into corresponding mount holes 432 to secure the mounting bracket 412 to the adaptor 400. The attachment flanges 454 are configured to secure the light fixture 202 to the mounting bracket 412.

The central region 406 of the adaptor 400 includes a central aperture 430 and a plurality of mount holes 432, as shown in FIGS. 6A-6C. The central aperture 430 is sized to receive both the central segment 450 of the bracket 412 and an extent of the power supply 204, as shown in FIGS. 5 and 6A. The depending side wall 442 surrounds the central aperture 430 and defines a cavity or receiver 456 in which the central segment 450 and power supply 204 reside in the installed position P1 of FIG. 5. As shown in FIG. 5, the central segment 450 and the upper portion of the power supply 204 are positioned above the lower end wall 444 of the adaptor 400. In this positional relationship, the durability and useful life of the power supply 204 is increased because the operating temperature of the power supply 204 is reduced during operation of the system 10 due to the ventilation of heat generated by the power supply 204 that the system 10 provides. Also in this positional relationship, the low-profile mounting configuration of the system 10 and the light fixture 202, as well as maintaining the first critical distance 326 and the second critical distance 332. Consequently, the depending side wall 442 blocks visibility to the power supply 204 to improve the aesthetics of the system 10.

Although the adaptor 400 is shown in the Figures and described herein as being secured to mounting bracket 412, it should be noted that mounting bracket 312 may be secured to adaptor 400 for attachment to light fixture 202. Similarly, it should be noted that the mounting bracket 412 may be secured to adaptor 300 for attachment to light fixture 202.

Figure 7:
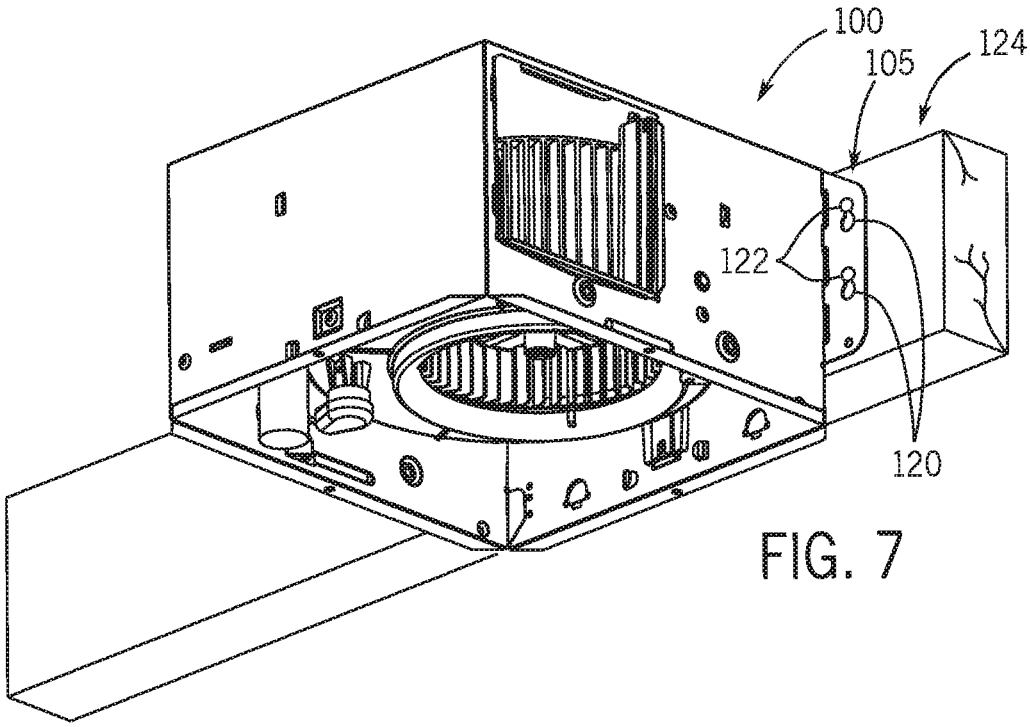
FIG. 7 is a bottom perspective view of the ventilation and illumination system showing the system coupled to a support structure in a first partially installed state.

The process of installing the system 10 above the ceiling 12 is now described with reference to the various installation stages of FIGS. 7-11. In general, an installer of the system 10, such as an electrician, carpenter or homebuilder, can install either of the adaptors 300, 400 to attain the first critical distance 326 while accommodating structural variances in the room or ceiling in which the system 10 is installed and that arise from the construction of the room or the overall building structure. The adaptor 300 is used to provide the first critical distance 326 and attain the air flow gap 302 to ensure sufficient air flow F, which then facilitates the operating performance of the system 10 and its long term durability. The primary installation steps of the system 10 are shown in FIGS. 7-11 and described in sequence below. Referring to FIG. 7, the ventilation assembly 100 includes at least one bracket 105 coupled to the external wall arrangement 109. The at least one mounting flange 105 includes a plurality of holes 120 that are sized to receive corresponding fasteners 122 to secure the ventilation assembly 100 to a support structure. The support structure is illustratively embodied as a ceiling joist 124 that is arranged above a room in the building structure.

Figure 8:
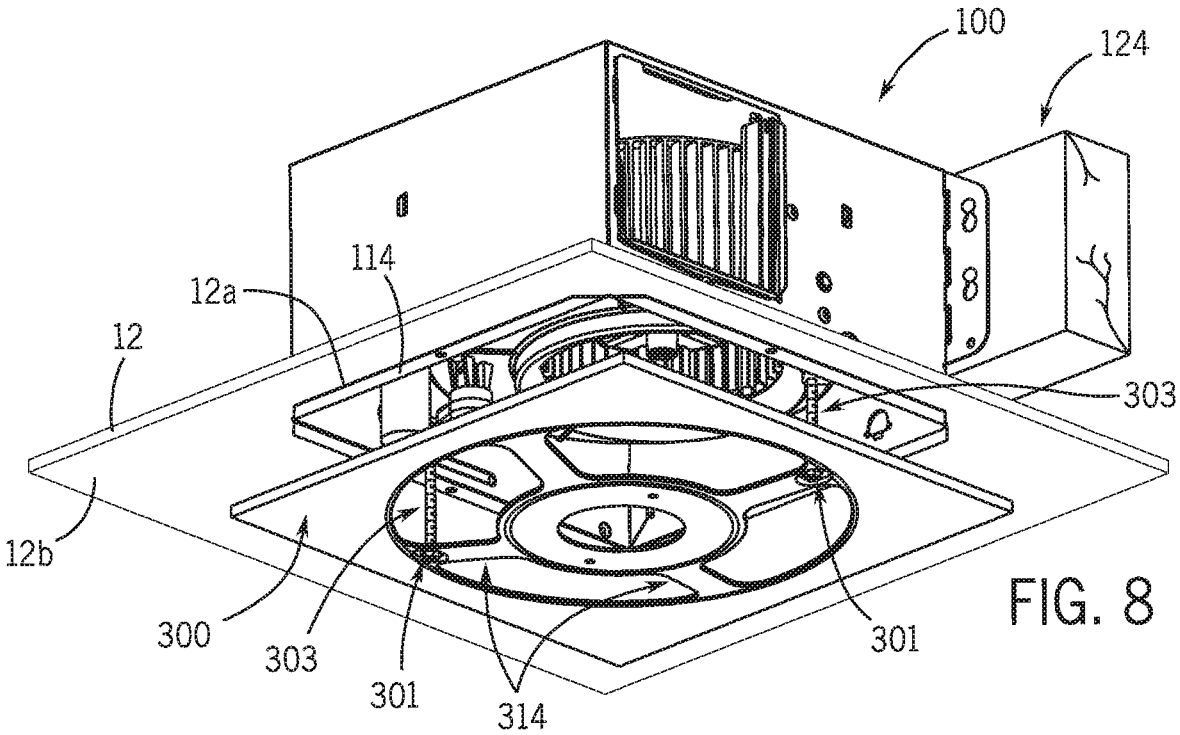
FIG. 8 is a bottom perspective view of the ventilation and illumination system in a second partially installed state, where the adaptor is positioned in close proximity to an aperture formed in the ceiling.

As shown in FIG. 8, a ceiling panel 12 is provided below the ventilation assembly 100. The aperture 12*a* is formed in the ceiling panel 12, typically cut, in a location that is aligned with the inlet opening 108 of the housing 102 when housing 102 is positioned above the ceiling 12. Next, the adaptor 300 is brought into close proximity to the ceiling aperture 12*a* so that it can be coupled to the main housing 102. The adaptor 300 includes a throughhole 314*a* formed in at least one of the arms 314 that receive fasteners 303. The fasteners 303 extend at least partially into the internal region 104 and are received by mounting flanges 117 included in the housing 102 to mount the adaptor 300. The adaptor 300 may also be affixed to the main housing 102 by using a plurality of weld studs or fasteners such as screws, bolts, or any other suitable fastener to join the adaptor 300 to the housing 102. Once coupled, the adaptor 300 spans and covers the ceiling aperture 12*a* such that the flange 308 resides outward and beyond the aperture 12*a*. The adaptor 300 is removable from the housing 102 by removing the fasteners 303 to allow for a service technician to access the blower assembly 106 and perform diagnostic and maintenance services on the blower assembly 106, as necessary.

Figure 9:
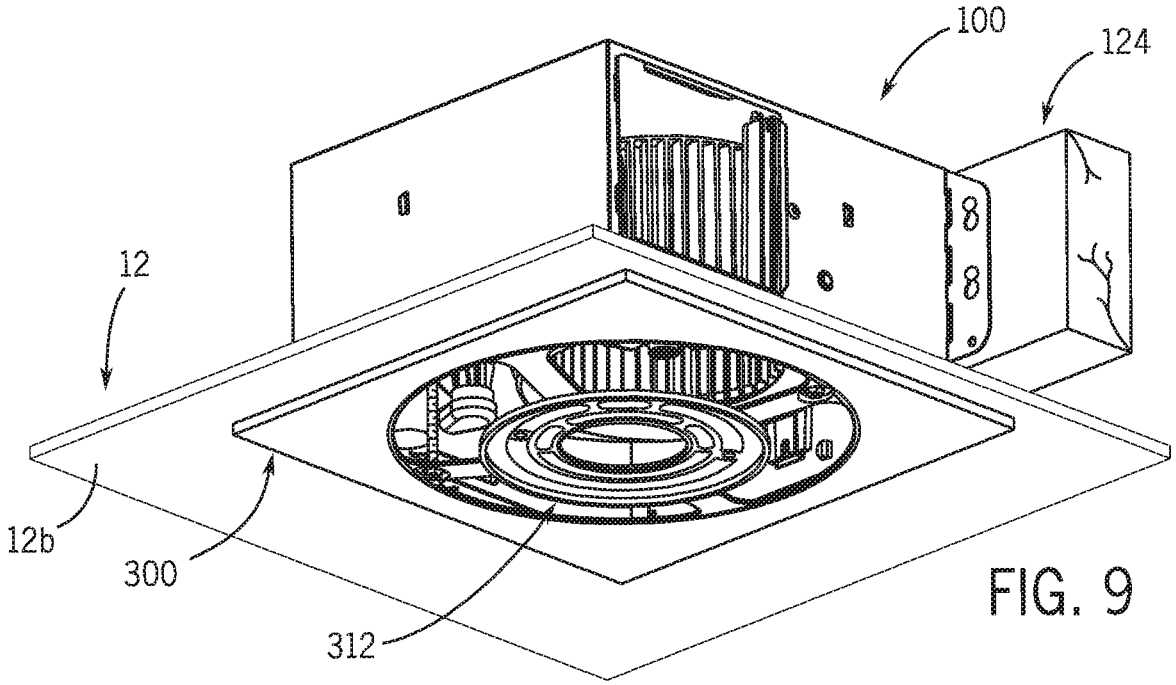
FIG. 9 is a bottom perspective view of the ventilation and illumination system in a third partially installed state, where the adaptor is coupled to the ventilation assembly and underlies the ceiling aperture, and a mounting bracket is coupled to the adaptor.

As shown in FIG. 9, the circular mounting bracket 312 is then coupled to the central region 306 of the adaptor 300. The mounting bracket 312 is used to couple the light fixture 202 to the adaptor 300. The central region 306 includes mounting apertures 331 that are configured to receive fasteners 371 to couple the mounting bracket 312 to the central region 306. When installed, the adaptor 300 and to a lesser extent, the mounting bracket 312, substantially obscure a sightline of a person standing in the room below the system 10 to the ceiling aperture 12*a* and into the inlet opening 108, which improves the aesthetic appearance of the system 10.

Figure 10:
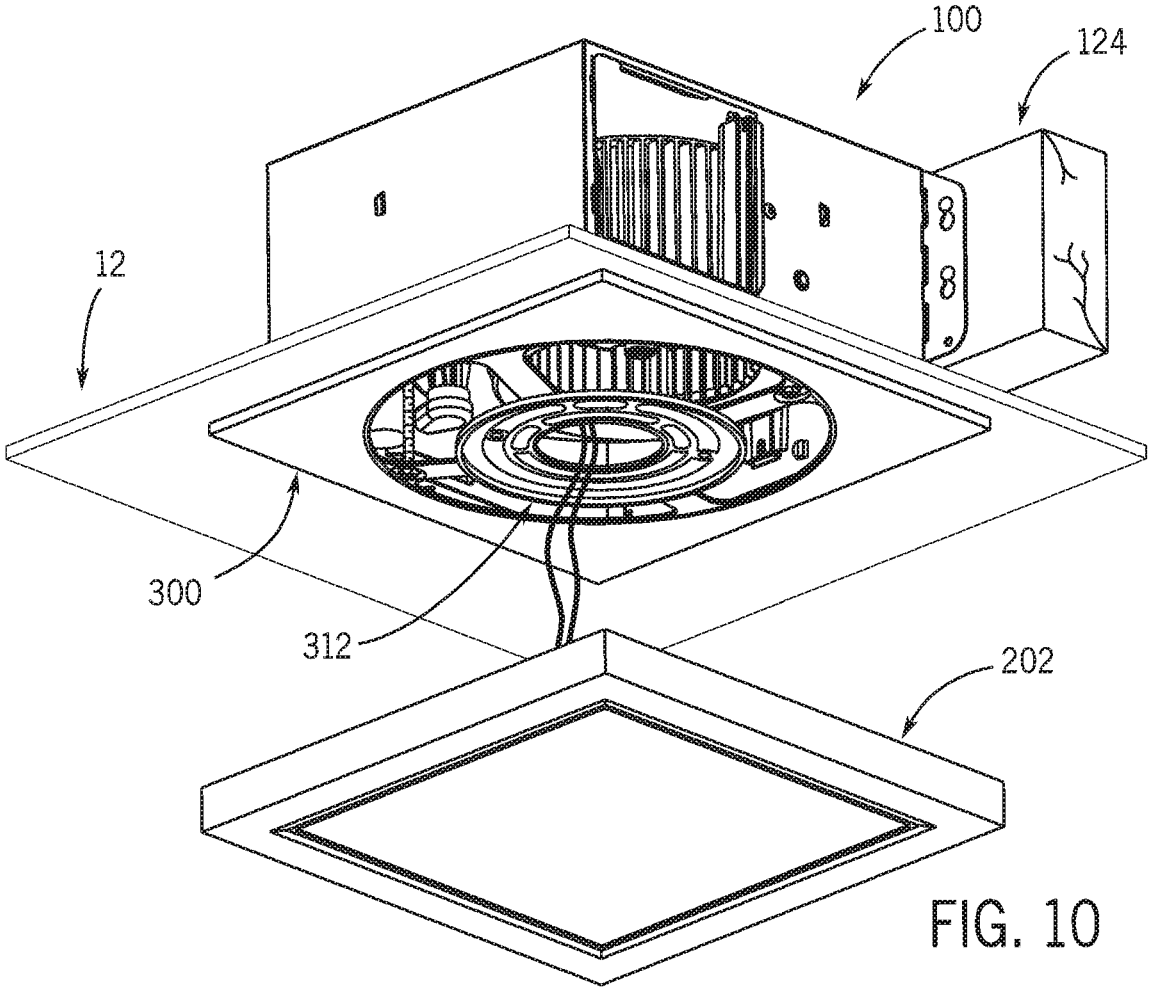
FIG. 10 is a bottom perspective view of the ventilation and illumination system in a fourth partially installed position, where electrical leads extend from a power supply in the ventilation assembly, through the adaptor and mounting bracket to the light fixture which is readied for mounting to the adaptor.
Figure 11:
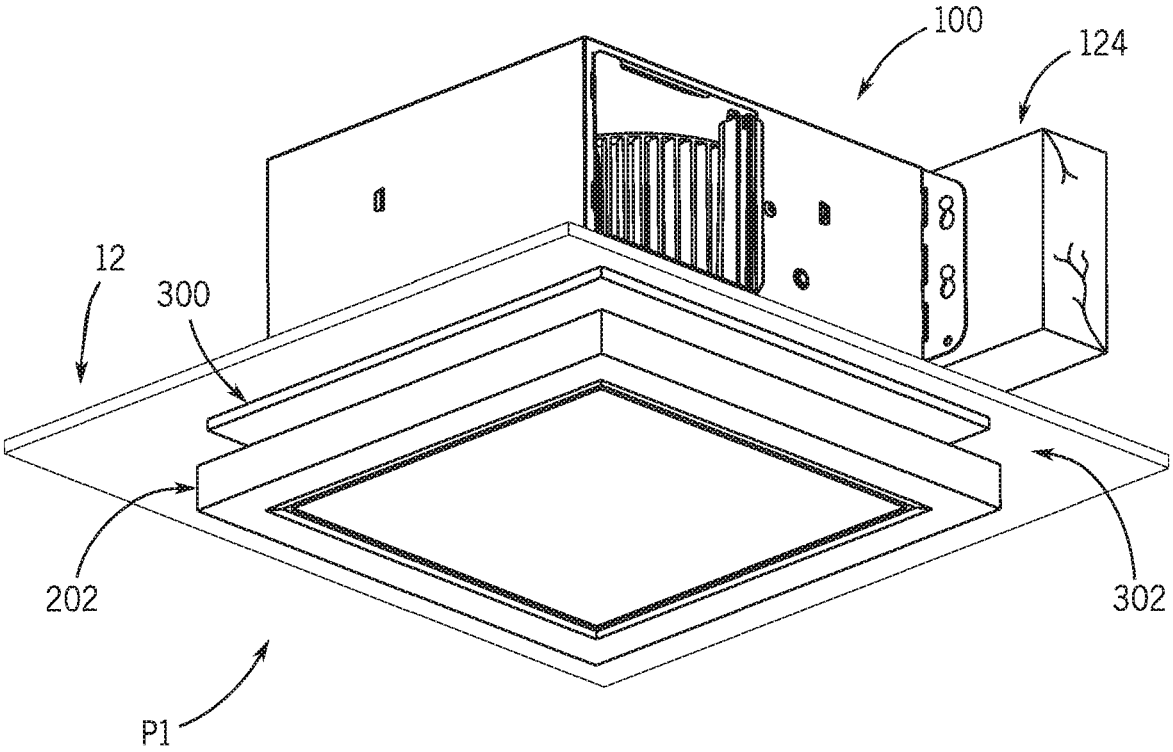
FIG. 11 is a bottom perspective view of the ventilation and illumination system in an installed position where an air flow cavity is defined between the light fixture and the ceiling.

Referring to FIGS. 10 and 11, the light fixture 202 is then readied to be affixed to the mounting bracket 312. An electrical connection is made between the wire leads 205 of the power supply 204 and the ventilation assembly 100. For example, the ventilation assembly may have a power adaptor, such as an electrical outlet, located within the internal region 104 of the housing 102. Alternatively, the electrical connection may be made with between the wire leads 205 and a remote power adaptor. Once the electrical connection is made, the light fixture 202 is mounted to the mounting bracket 312, as shown in FIG. 11, to reach the installed position P1 and provide the gap 302. The light fixture 202 may be affixed to the mounting bracket 312 using fasteners such as screws, bolts, or any other suitable fastener to join the light fixture 202 to the bracket 312. Alternatively, the light fixture may be equipped with a plurality of keys (not shown) that are configured to mate with corresponding keyways in the mounting bracket 312 and secure the light fixture 202 upon a slight rotation of the light fixture 202 relative to the bracket 312. It should be noted that although only adaptor 300 is shown in FIG. 9-11 and described during the assembly process, other adaptors such as adaptors 400, 500, and 600 described herein, may be installed in substantially the same manner as is described above.

Figure 12A:
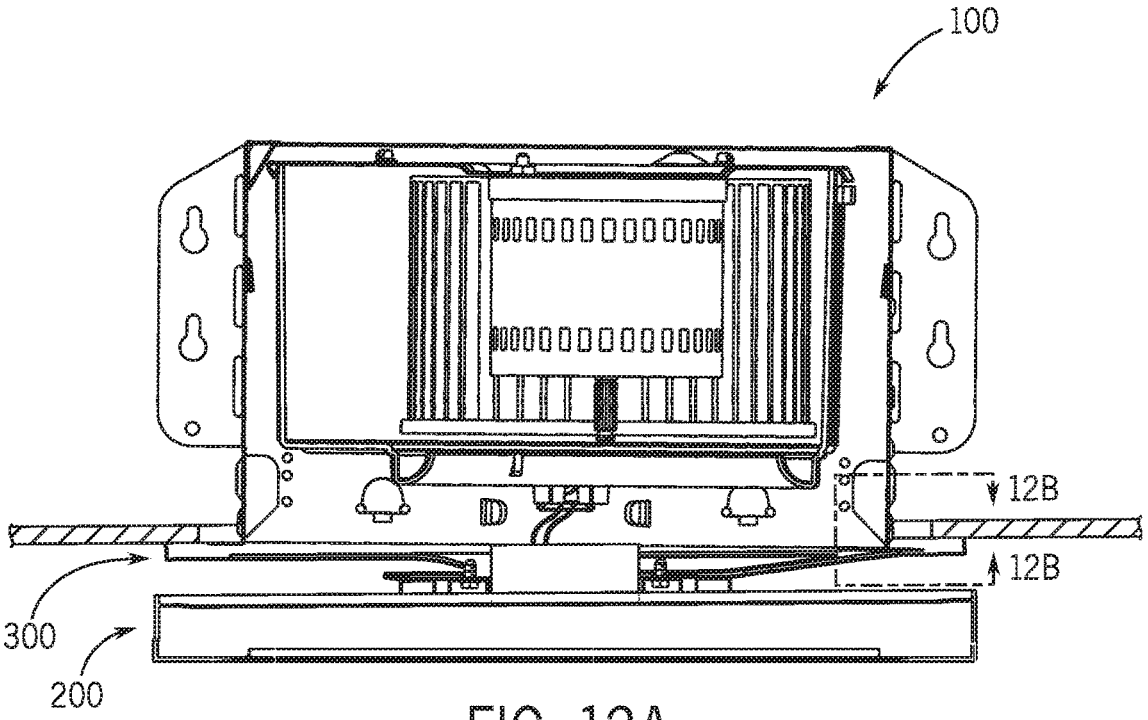
FIG. 12A is a cross sectional view of the ventilation and illumination system showing the ventilation assembly being offset mounted relative to the ceiling.
Figure 12B:
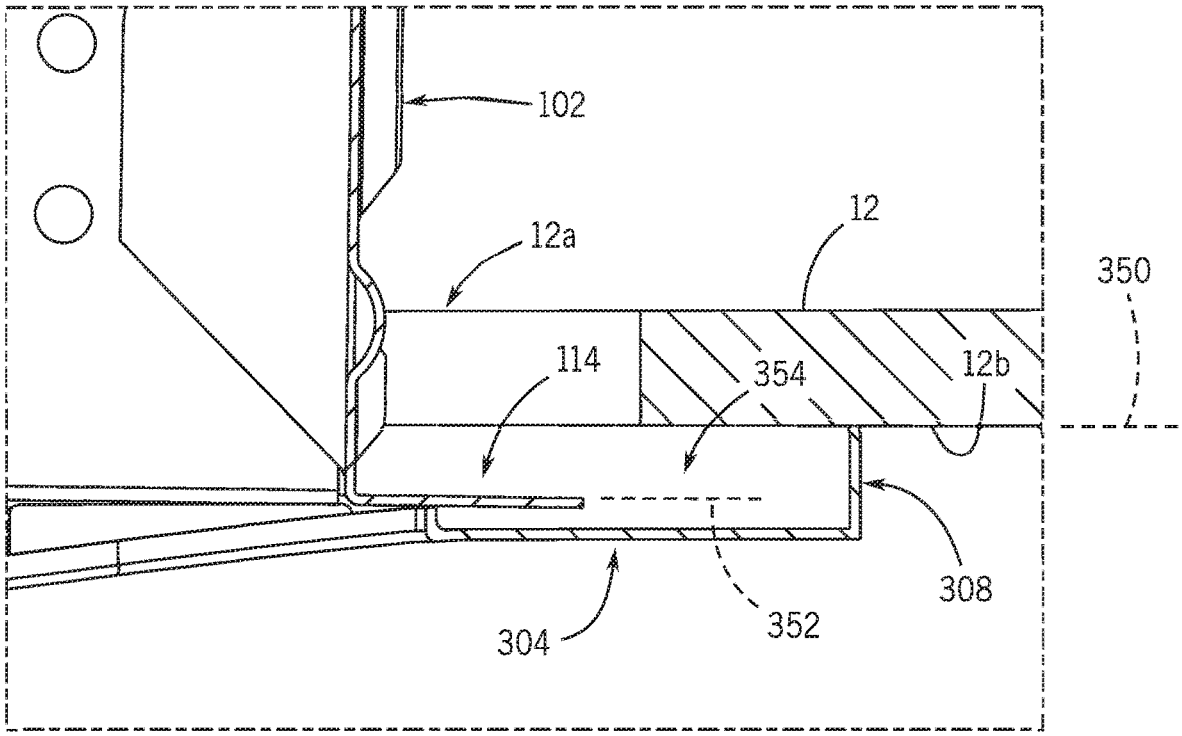
FIG. 12B is an enlarged cross sectional view of the dashed region in FIG. 12A showing the extent of the offset mount of the ventilation assembly relative to the ceiling while the adaptor defines a cavity that receives the housing flange to accommodate the offset mounting.
Figure 13:
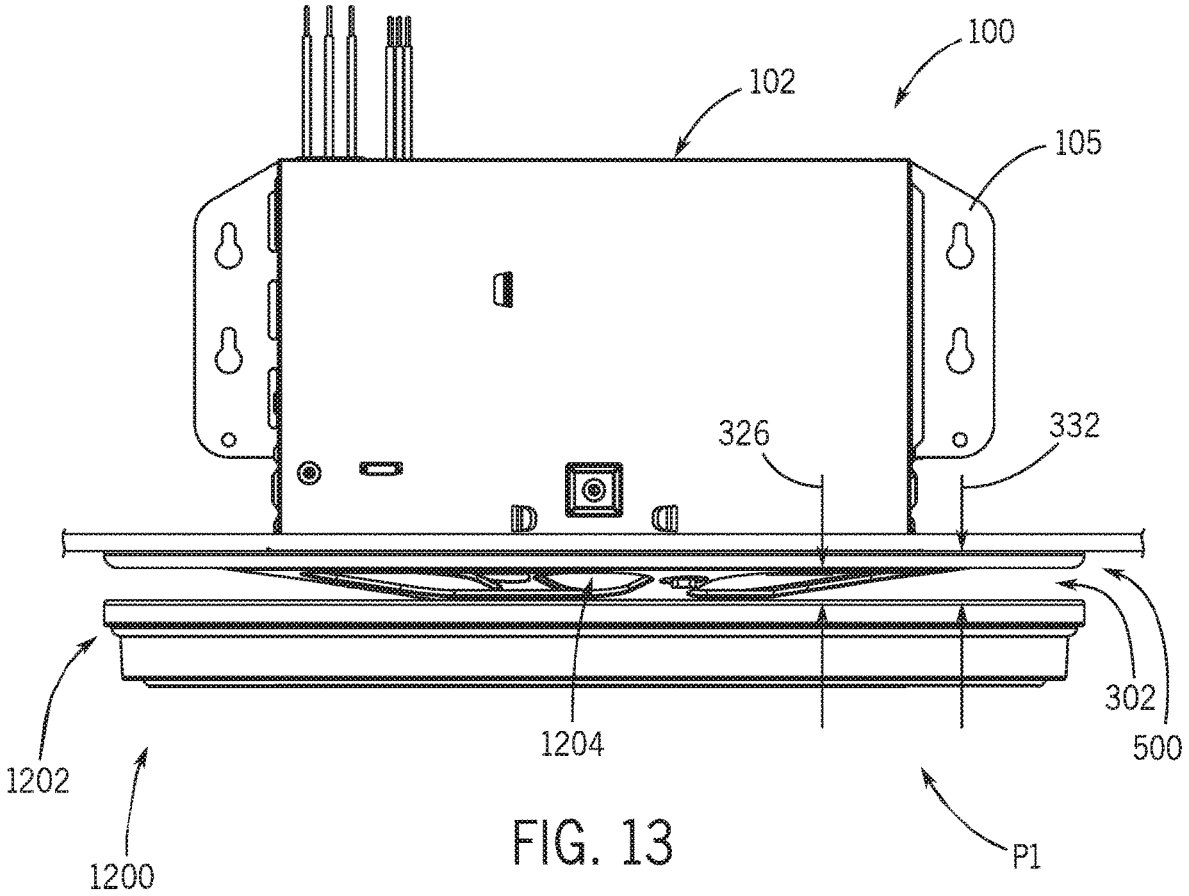
FIG. 13 is a side view of a third embodiment of the integrated ventilation and illumination system showing an alternate adaptor coupled between the ventilation assembly and a light fixture assembly and arrows indicating both a first critical dimension and a second critical dimension provided by the adaptor between the light fixture assembly and the ceiling.
Figure 14:
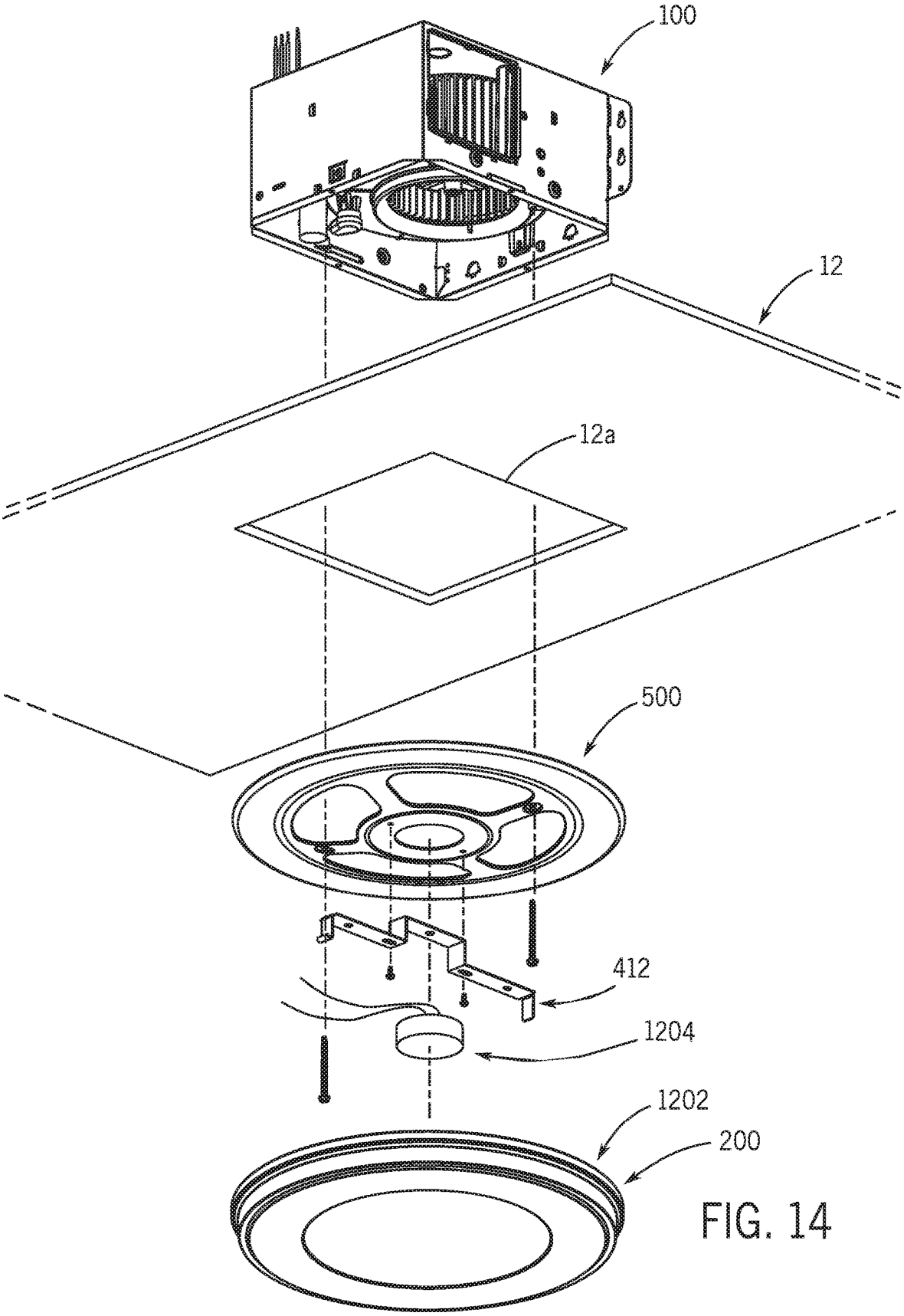
FIG. 14 is an exploded view of the ventilation and illumination system of FIG. 13 relative to the ceiling.

Another aspect of the system 10 is shown in FIGS. 12A and 12B. Namely, the adaptor 300, including the peripheral flange 308, is specifically configured to accommodate a ventilation assembly 100 that is offset mounted relative to the ceiling 12, meaning that the ventilation assembly 100 is not installed parallel to the ceiling 12. Ideally, the ventilation assembly 100 is mounted above the room such that a lower flange 114 of the housing 102 resides adjacent to and substantially parallel to the ceiling 12, namely the lower ceiling surface 12*b*. Consequently a reference plane 350 of the ceiling surface 12*b* is coplanar with a reference plane 352 of the lower housing flange 114. However, as shown in FIGS. 12A and B, the ventilation assembly 100 is improperly installed in an offset position such that the reference plane 350 is misaligned with the reference plane 352. In this state, removal and reinstallation of the ventilation system 100 by an electrician or carpenter is not practical because the removal and reinstallation process is time-consuming and costly, as well as relatively difficult because the ventilation assembly 100 may not be easily accessible through the ceiling 12.

Focusing on FIG. 12B, the lower housing flange 114 is not adjacent to or flush with the lower ceiling surface 12*b* such that the flange 114 extends well past the ceiling aperture 12*a* and into the room. This positional relationship causes the misalignment of the reference planes 350, 352 discussed above and creates an unsightly gap 355 between flange 114 and the ceiling 12 that can also cause air leaks. However, the adaptor 300 is installed, as described above, where the upper edge of the peripheral flange 308 contacts the lower ceiling surface 12*b*. The peripheral flange 308 has a sufficient height dimension to provide a clearance or gap between the lower ceiling 12*b* surface and the peripheral adaptor region 304 to accommodate the housing flange 114 and block visibility of the misalignment of the reference planes 350, 352 and the gap 355. In this way, the peripheral flange 308 accommodates and hides the misalignment of the planes 350, 352 and the gap 355, which improves the aesthetics of the system 10. Because of the accommodation provided by the adaptor 300, the light fixture assembly 200 can be installed parallel to the ceiling 12 even though the ventilation assembly 100 was installed offset relative to the ceiling 12.

FIGS. 13-16D illustrate an alternate adaptor 500 according to the present disclosure, wherein like numerals represent like elements of the system 10. The adaptor 500 shares many of the same elements and features described above with reference to the illustrated embodiment of adaptor 300 of FIGS. 1-5D, however, the adaptor 500 is circular to accommodate a corresponding circular light fixture assembly 1200. As previously noted, this configuration provides for greater aesthetics of the system 10 while the adaptor 500 underlies and spans the housing inlet opening 108 and the ceiling aperture 12*a* to obscure it from view by a person standing in the room in which the system 10 is installed.

The light-fixture assembly 1200 includes a light fixture 1202 with a circular configuration, and a power supply 1204 as shown in FIGS. 13-16D. The power supply 1204 is coupled to an upper surface 1208 of the light fixture 1202 in a generally central region of the upper surface 1208. Wire leads 1205 electrically connect the power supply to the ventilation assembly 100 to power the light fixture 1202.

The adaptor 500 provides the first critical distance 326 and the second critical distance 332. Similarly to adaptor 300, the adaptor 500 includes a peripheral region 504 and a central region 506 that is offset from the peripheral region 504. The adaptor 500 also includes a peripheral flange 508 that provides the same function as peripheral flange 308. At least one arm 514 extends between the peripheral region 504 and the central region 506. Specifically, the arms 514 extend from an inner edge 516 of the peripheral region 504 and converge at an outer edge 518 of the central region 506. The plurality of arms 514 are angled relative to the peripheral region 504 and the central region 506 to provide the offset between the peripheral region 504 and the central region 506 and the first critical distance 326. As a result, the adaptor 500 has an overall height of at least 0.5 inch, and preferably 0.75 inch, that ensures the first critical distance 326 without creating a first critical distance 326 that would provide an unappealing aesthetic appearance for the system 10. At least one arm 514 includes an aperture 514*a* that may be positioned within a recessed cavity and that receives a fastener 303 to couple the adaptor 500 to the housing 102.

At least one opening 505 is formed between the peripheral region 504 and the central region 506 to allow for the required air flow F to flow around the light fixture 1202, through the openings 505, and into the internal region 104 of the housing 102. As shown in FIG. 16B, each arm 514 separates the openings 505 from one another. The peripheral region 504 has an outermost dimension that is greater than an outermost dimension of the housing 102 and the aperture 12*a* in ceiling 12. The peripheral region 504 blocks visibility of the aperture 12*a* from the room in which the system 10 is connected. The central region 506 has an outermost dimension that is less than the outermost dimension of the peripheral region 504 and the outermost dimension of the housing 102.

Figure 15:
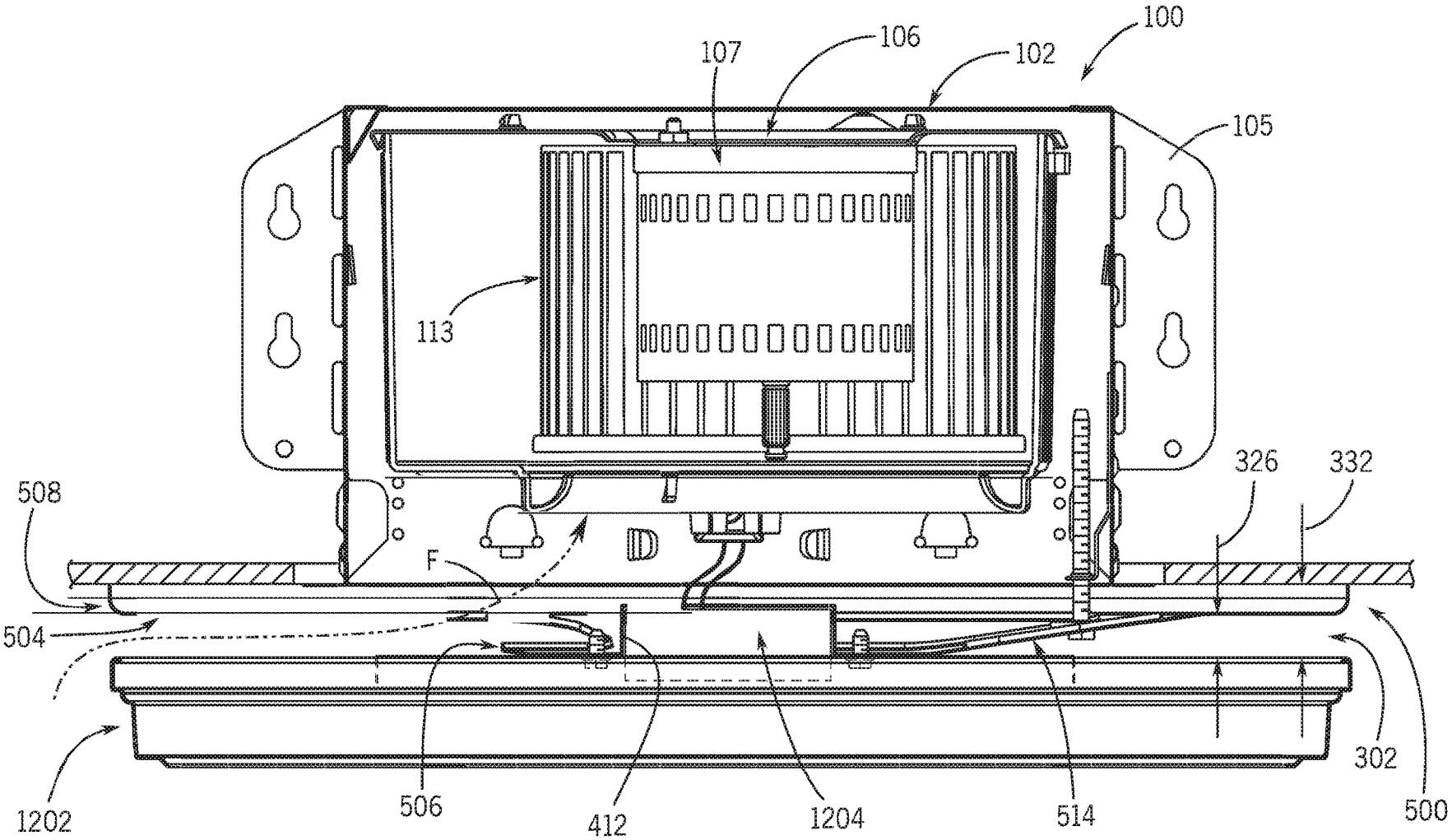
FIG. 15 is a side view of the ventilation and illumination system installed above the ceiling with a side wall of the housing removed and arrows indicating both the first critical dimension and the second critical dimension provided by the adaptor between the light fixture assembly and the ceiling.
Figure 16A:
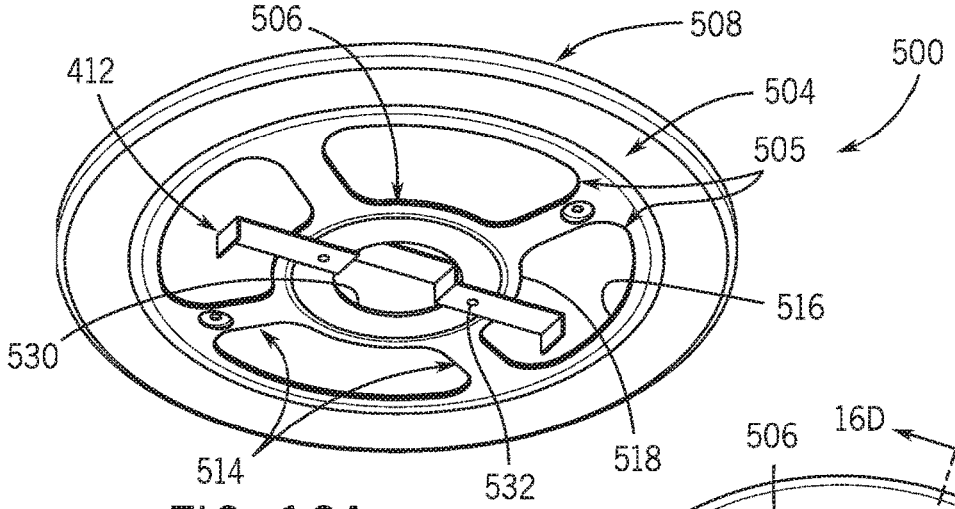
FIG. 16A is a bottom perspective view of the adaptor of FIG. 13, showing a mounting bracket affixed to the adaptor.
Figure 16B:
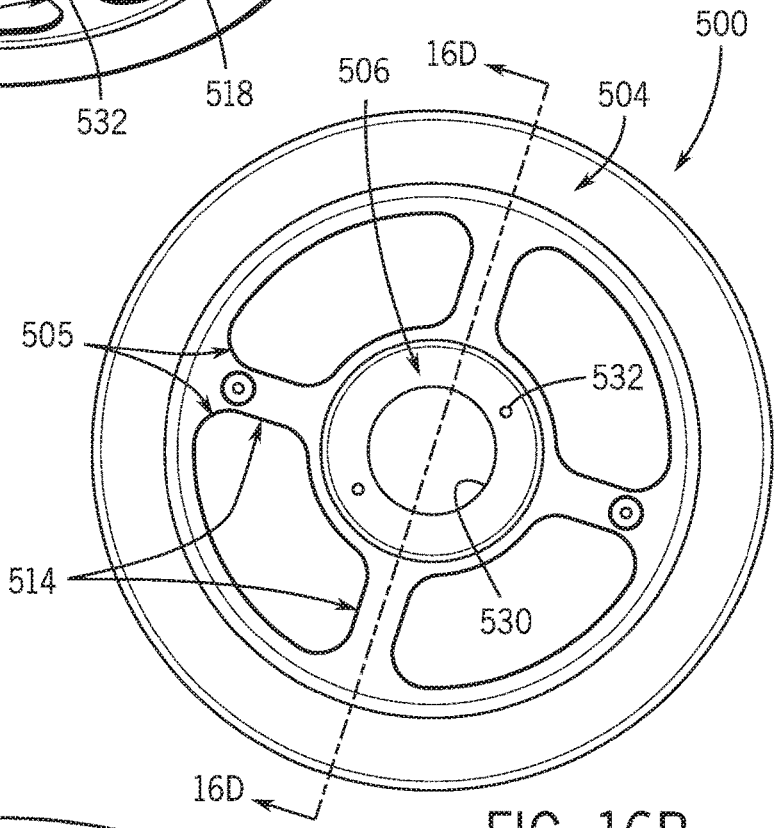
FIG. 16B is a bottom view of the adaptor of FIG. 13 without the mounting bracket of FIG. 16A.
Figure 16C:
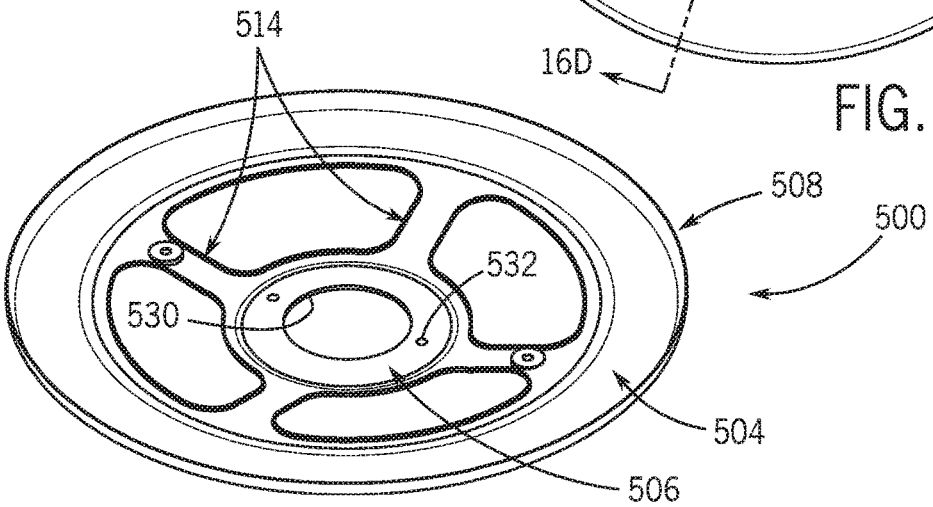
FIG. 16C is a top perspective view of the adaptor of FIG. 13.
Figure 16D:
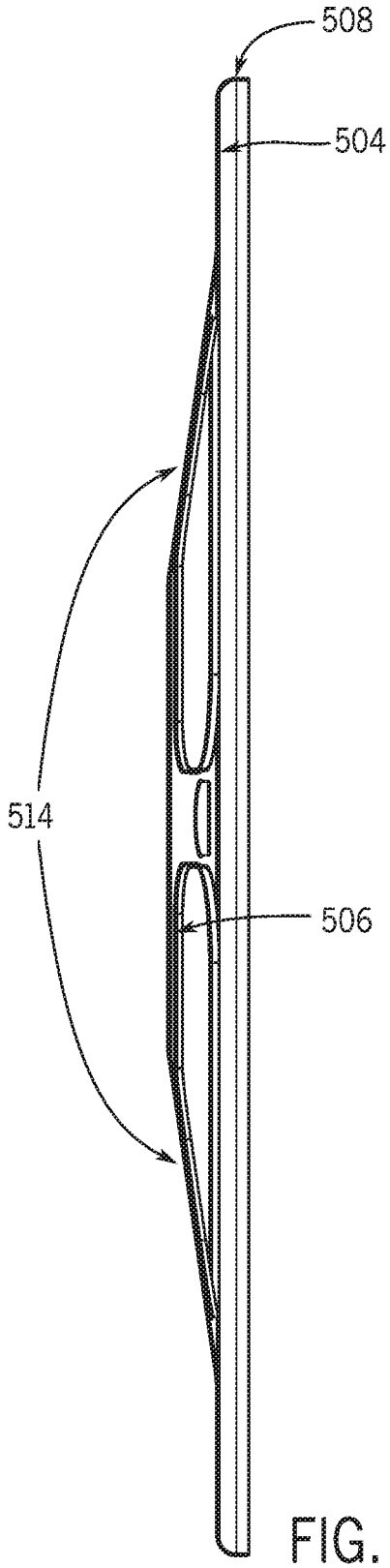
FIG. 16D is a cross sectional view of the adaptor of FIG. 13 taken along line 16D-16D in FIG. 16B.

The central region 506 of the adaptor 500 includes a central aperture 530 and a plurality of mount holes 532 as shown in FIGS. 16A-16C. The central aperture 530 is sized to receive both the central segment 450 of the bracket 412 and an extent of the power supply 1204. As shown in FIG. 5, the central segment 450 and the upper portion of the power supply 1204 are positioned above the central region of the adaptor 500. With the power supply 1204 mounted above the light fixture 1202 and received in the central aperture 530, as opposed to within the light fixture 1202, durability and useful life of the power supply 1204 can be increased because the operating temperature of the power supply 1204 is reduced due to the ventilation of heat generated by the power supply 204 that the system 10 provides. The mounting bracket 412 is arranged to couple to the central region 506 to mount the light fixture 1202 to the adaptor 500. The light fixture 1202 is then secured to the mounting bracket 412 to provide the installed position P1 as shown in FIG. 15.

Figure 18D:
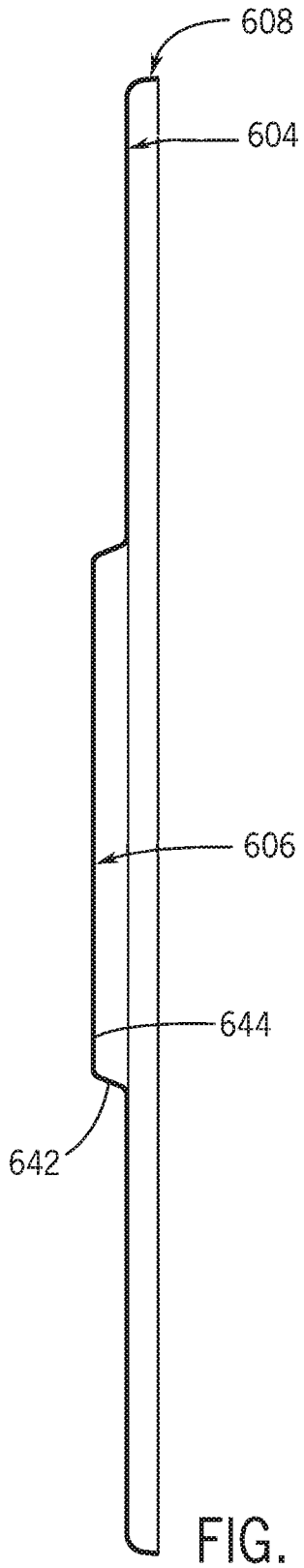
FIG. 18D is a cross sectional view of the adaptor of FIG. 17 taken along line 18D-18D in FIG. 18B.
Figure 17:
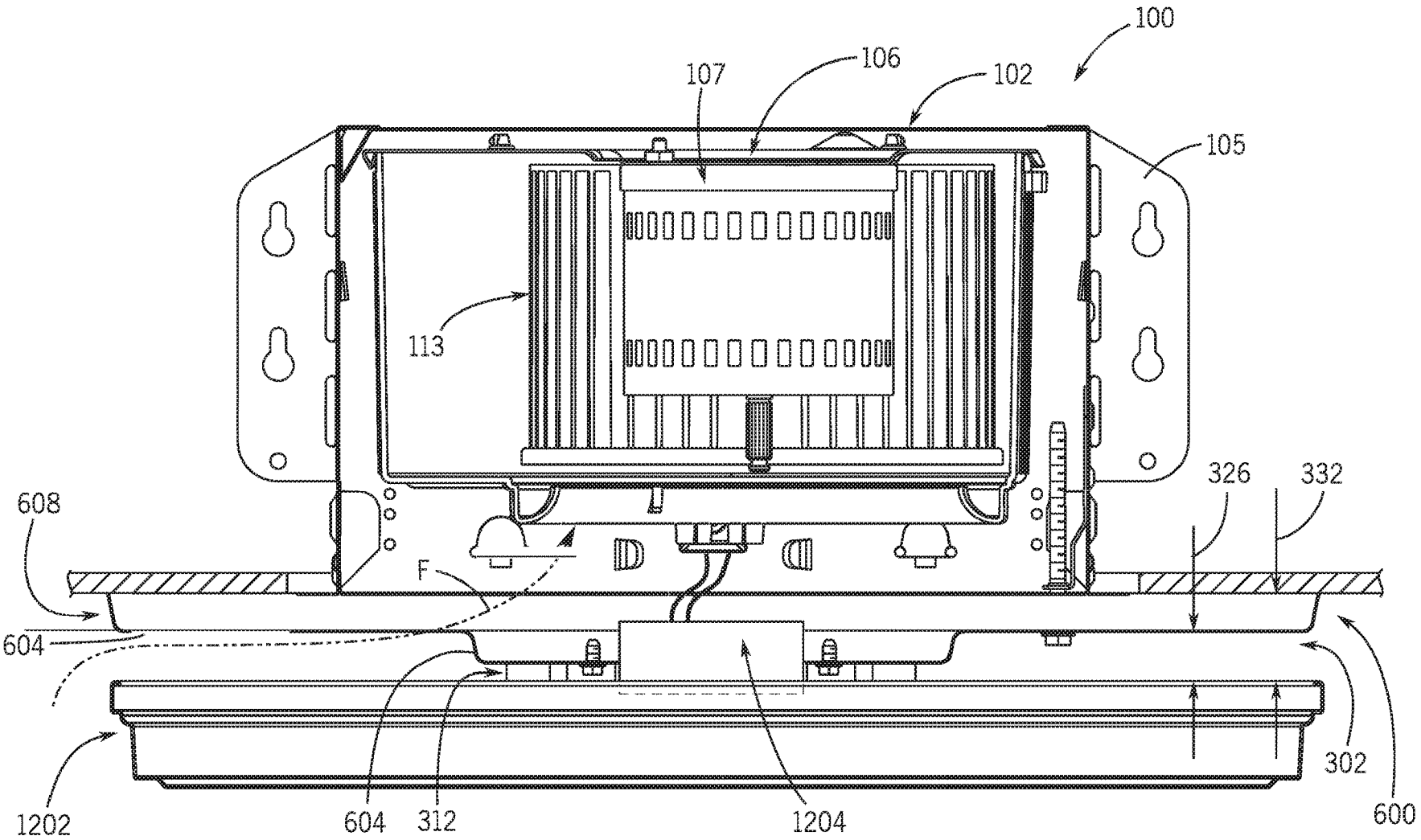
FIG. 17 is a side view of a fourth embodiment of the integrated ventilation and illumination system in the installed position showing an alternate adaptor coupled between the ventilation assembly and a light fixture assembly and arrows indicating both the first critical dimension and the second critical dimension provided by the adaptor between the light fixture assembly and the ceiling.

FIGS. 17-18D illustrate an alternate adaptor 600 according to the present disclosure, wherein like numerals represent like elements of the system 10. The adaptor 600 shares many of the same elements and features described above with reference to the illustrated embodiment of adaptor 400 of FIGS. 5-6D, however, the adaptor 600 is circular to accommodate the corresponding circular light fixture 1202. As previously noted, this configuration provides for greater aesthetics of the system 10 while the adaptor 600 underlies and spans the housing inlet opening 108 and the ceiling aperture 12*a* to obscure it from view by a person standing in the room in which the system 10 is installed.

The adaptor 600 provides the first critical distance 326 and the second critical distance 332. Similarly to adaptor 400, the adaptor 600 includes a peripheral region 604 and a central region 606 that is at least partially offset from the peripheral region 604. The adaptor 600 may also include a peripheral flange 608 that provides the same function as peripheral flange 408. At least one arm 614 extends between the peripheral region 604 and the central region 606. Specifically, the arms 614 extend from an inner edge 616 of the peripheral region 604 and converge at an outer edge 618 of the central region 606. The arms 614 are coplanar with the peripheral region 604 as shown in FIG. 18D. At least one arm 614 includes an aperture 614*a* that may be positioned within a recessed cavity and that receives a fastener 303 to couple the adaptor 600 to the housing 102.

Figure 18A:
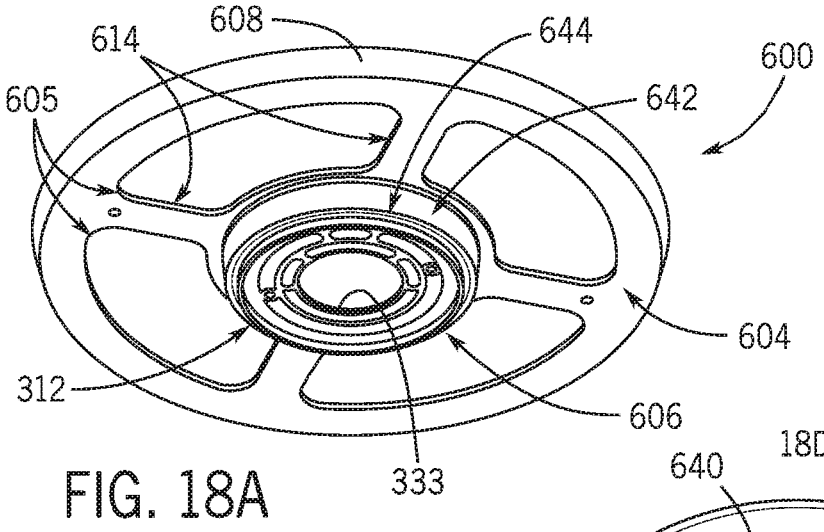
FIG. 18A is a bottom perspective view of the adaptor of FIG. 17, showing a mounting bracket affixed to the adaptor.
Figure 18B:
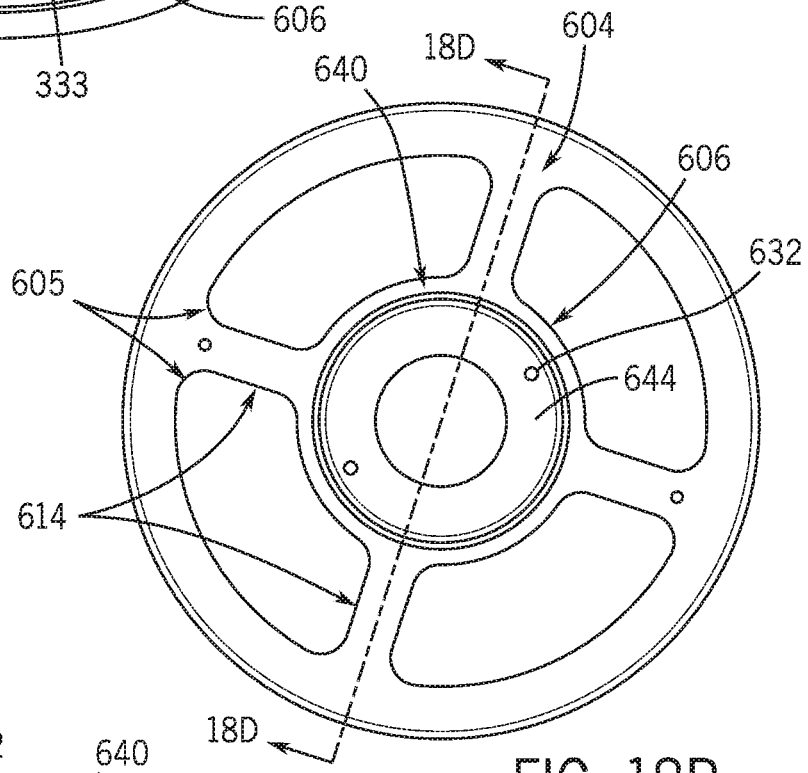
FIG. 18B is a bottom view of the adaptor of FIG. 17 without the mounting bracket of FIG. 18A.
Figure 18C:
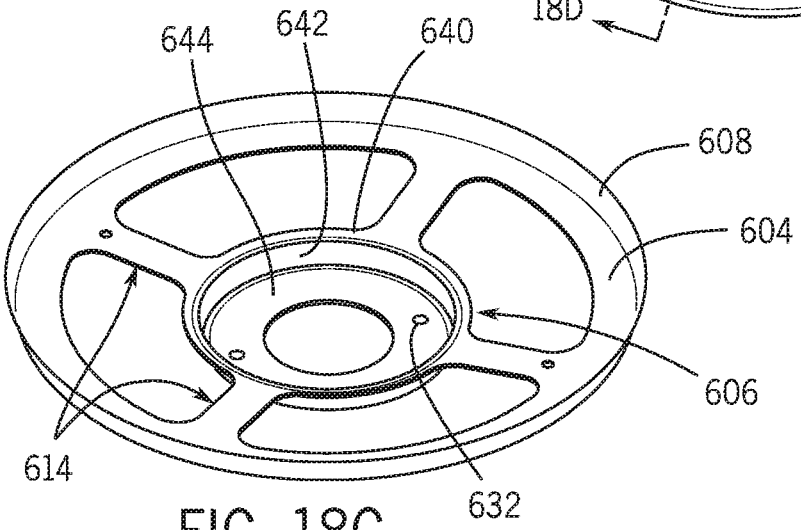
FIG. 18C is a top perspective view of the adaptor of FIG. 17.

At least one opening 605 is formed between the peripheral region 604 and the central region 606 to allow for the required air flow F to flow around the light fixture 1202 through the openings 605 and into the internal region 104 of the housing 102. As shown in FIGS. 18A-18C, each arm 614 separates the openings 605 from one another. The peripheral region 604 has an outermost dimension that is greater than an outermost dimension of the housing 102 and the aperture 12*a* in ceiling 12. The peripheral region 604 blocks visibility of the aperture 12*a* from the room in which the system 10 is connected. The central region 606 has an outermost dimension that is less than the outermost dimension of the peripheral region 604 and the outermost dimension of the housing 102.

The central region 606 includes an upper flange 640 that provides the outer edge 618 to which each arm 614 is coupled as shown in FIGS. 18A-18D. The central region 606 further includes a depending side wall 642 that extends downwardly away from the upper flange 640 to provide the first critical distance 326. A lower end wall 644 is coupled to a lower extent of the depending side wall 642 and extends parallel with the upper flange 640. As a result, the adaptor 600 has an overall height of at least 0.5 inch, and preferably 0.75 inch, that ensures the first critical distance 326 without creating a first critical distance 326 that would provide an unappealing aesthetic appearance for the system 10. The lower end wall 644 is configured to support the mounting bracket 312 to couple the light fixture 1202 to the adaptor 600.

The central region 606 of the adaptor 600 includes a central aperture 630 and a plurality of mount holes 632 as shown in FIGS. 18A-18D. The central aperture 630 is sized to receive the power supply 1204 as shown in FIG. 17. The depending side wall 642 defines a cavity 656 in which the power supply 1204 lies in the installed position P1. Also, the depending side wall 642 blocks visibility to the power supply 1204 to provide greater aesthetics for the system 10.

Although adaptor 600 is shown and described herein as being secured to mounting bracket 312, it should be noted that mounting bracket 412 may be secured to adaptor 600 for attachment to light fixture 1202. It should also be noted that mounting bracket 312 may be secured to adaptor 500 for attachment to light fixture 1202.

FIGS. 19A-19D illustrate another embodiment of the adaptor 700 according to the present disclosure, wherein like numerals represent like elements of the system 10. The adaptor 700 shares many of the same elements and features described above with reference to the illustrated embodiment of adaptor 300 of FIGS. 1-5D and adaptor 500 of FIGS. 13-16D. The adaptor 700 is intended to mount the light fixture assembly 200 to the ventilation assembly 100 while underlying and spanning the ceiling aperture 12*a* to obscure it from view by a person standing in the room in which the system 10 is installed.

The adaptor 700 provides the first critical distance 326 and the second critical distance 332, as discussed above. The adaptor 700 includes a peripheral region 704 and a central region 706 that is offset from the peripheral region 704. The adaptor 700 may also include a peripheral flange 708 that provides the same function as peripheral flange 308. A plurality of arms 714 extend from the peripheral region 704 to the central region 706. Specifically, the arms 714 extend from an inner edge 716 of the peripheral region 704 and converge at an outer edge 718 of the central region 706. The plurality of arms 714 are angled relative to the peripheral region 704 and the central region 706 to provide the offset between the peripheral region 704 and the central region 706 and the first critical distance 326. As a result, the adaptor 700 has an overall height of at least 0.5 inch, and preferably 0.75 inch, that ensures the first critical distance 326 without creating a first critical distance 326 that would provide an unappealing aesthetic appearance for the system 10. At least one arm 714 includes an aperture 714*a* that may be positioned within a recessed cavity and that receives a fastener 303 to couple the adaptor 700 to the housing 102.

At least one opening 705 is formed between the peripheral region 704 and the central region 706 to allow for the air flow F to flow around the light fixture 202 through the openings 705 and into the internal region 104 of the housing 102. Each arm 714 separates the openings 705 from one another. The peripheral region 704 has an outermost dimension that is greater than an outermost dimension of the housing 102 and the aperture 12*a* in ceiling 12. The peripheral region 704 blocks visibility of the aperture 12*a* from the room in which the system 10 is connected. The central region 706 has an outermost dimension that is less than the outermost dimension of the peripheral region 704 and the outermost dimension of the housing 102.

The central region 706 of the adaptor 700 includes a central aperture 730 and a plurality of mount holes 732 as shown in FIGS. 19A-19D. The central aperture 730 is sized to receive the power supply 204. The mounting bracket 312 is arranged to couple to the central region 706 to mount the light fixture 202 to the adaptor 700. The light fixture 202 may then be secured to the mounting bracket 312 to provide the installed position P1.

Figure 19A:
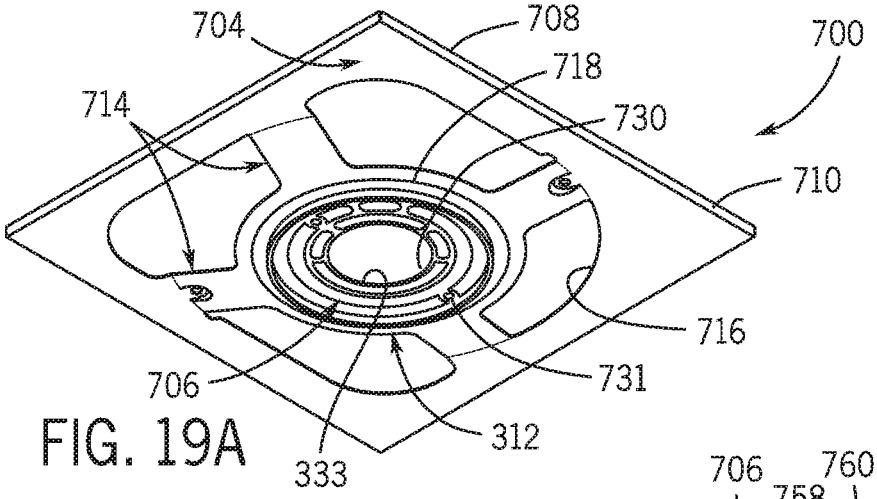
FIG. 19A is a bottom perspective view of a fifth embodiment of an adaptor, showing a mounting bracket affixed to the adaptor.
Figure 19B:
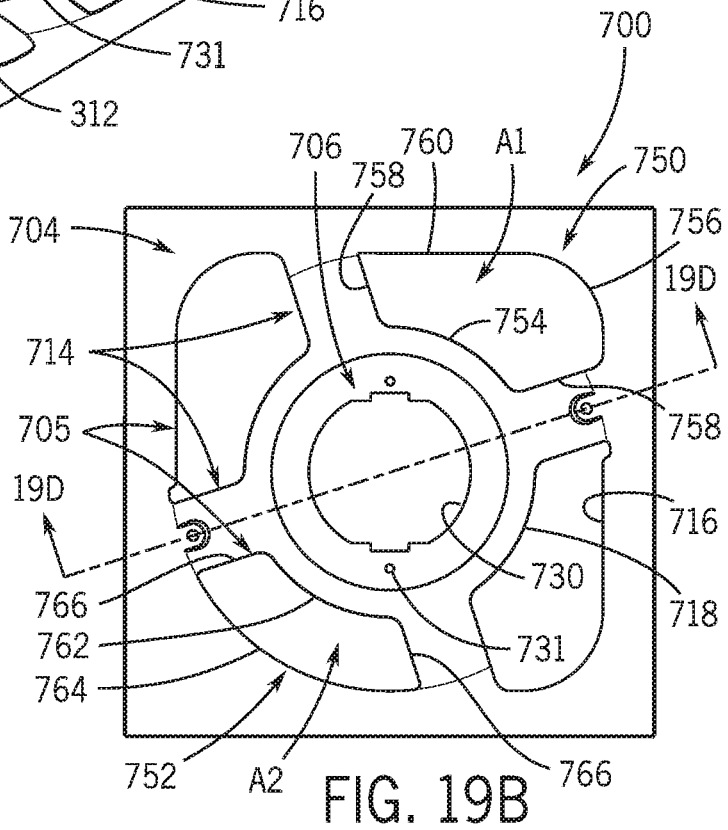
FIG. 19B is a bottom view of the adaptor of FIG. 19A without the mounting bracket.
Figure 19C:
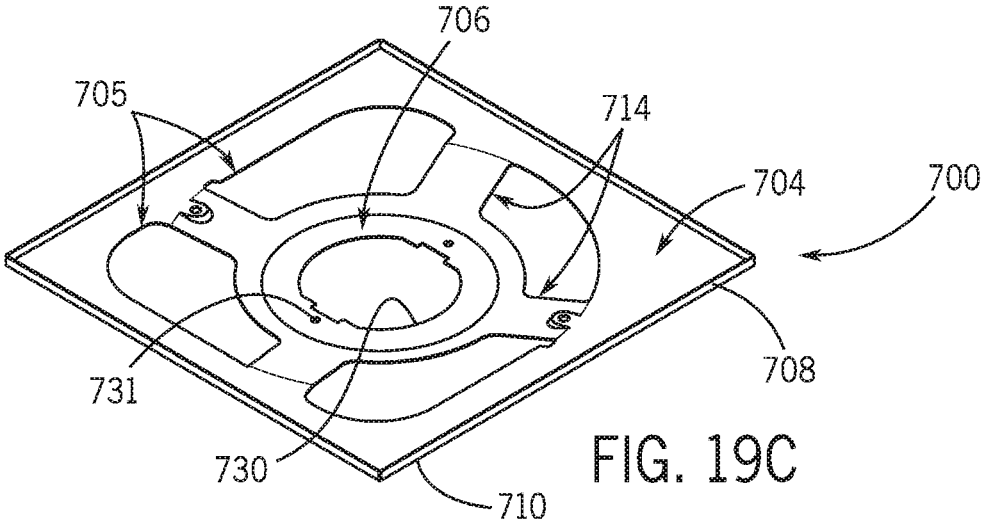
FIG. 19C is a top perspective view of the adaptor of FIG. 19A.
Figure 19D:
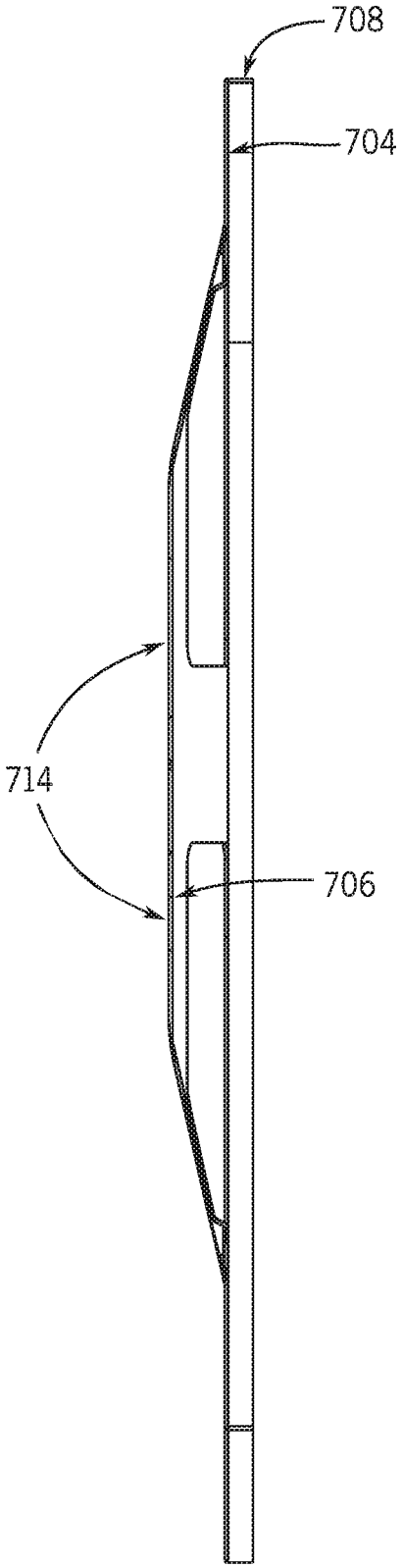
FIG. 19D is a cross sectional view of the adaptor taken along line 19D-19D in FIG. 19B.

Unlike the openings 305, 405, the openings 705 are asymmetric and do not have the same opening area. The plurality of openings 705 are sized to allow a user or a technician to access the blower assembly and/or electrical systems contained within the internal region 104 of the housing 102 without removing the adaptor 700 from the housing 100. At least one of the openings 705 includes an area that is greater than the other openings 705. For example, as shown in FIG. 19B, a first opening 750 includes a larger periphery with a lobe region that provides the first opening 750 with a first opening area A1. A second opening 752 includes a lesser periphery that provides it with a second opening area A2 that is smaller than the first area A1. In this way, the technician may access the blower assembly or electrical systems in the internal region 104 of the housing 102 using the first opening 750 without disconnecting the adaptor 700 from the housing 100.

Any suitable shape may be provided for the openings 705. In the illustrative embodiment, the first opening 750 includes an inner curvilinear edge 754 with a first cord length and an outer curvilinear edge 756 with a second cord length that is less than the first cord length. The first opening further includes a pair of substantially linear side edges 758 and a substantially linear outer edge 760. The second opening 752 includes an inner curvilinear edge 762 with a third cord length that is about equal to the first cord length and an outer curvilinear edge 764 with a fourth cord length that is greater than the first, second and third cord lengths. The second opening 752 further include a pair of substantially linear side edges 766.

FIGS. 20A-20D illustrate another adaptor 800 for use in system 10, according to the present disclosure, wherein like numerals represent like elements of the adaptor 800. The adaptor 800 shares many of the same elements and features described above with reference to the illustrated embodiment of adaptors 400 of FIGS. 5-6D and 600 of FIGS. 17-18D. The adaptor 800 is adapted for use with ventilation assembly 100 and light fixture assembly 1200 to mount the light fixture assembly 1200 to the ventilation assembly 100 while underlying and spanning the ceiling aperture 12*a* to obscure it from view by a person standing in the room in which the system 10 is installed.

The adaptor 800 provides the first critical distance 326 and the second critical distance 332, as discussed above. The adaptor 800 includes a peripheral region 804 and a central region 806 that is at least partially offset from the peripheral region 804. The adaptor 800 also includes a peripheral flange 808 that provides the same function as peripheral flange 308. A plurality of arms 814 extend between the peripheral region 804 and the central region 806. Specifically, the arms 814 extend from an inner edge 816 of the peripheral region 804 and converge at an outer edge 818 of the central region 806. The plurality of arms 814 are angled relative to the peripheral region 804 and the central region 806 to provide the offset between the peripheral region 804 and the central region 806 and the first critical distance 326. As a result, the adaptor 800 has an overall height of at least 0.5 inch, and preferably 0.75 inch, that ensures the first critical distance 326 without creating a first critical distance 326 that would provide an unappealing aesthetic appearance for the system 10. At least one arm 814 includes an aperture 814*a* that may be positioned within a recessed cavity and that receives a fastener 303 to couple the adaptor 800 to the housing 102.

At least one opening 805 is formed between the peripheral region 804 and the central region 806 to allow for the air flow F to flow around the light fixture 1202 through the openings 805 and into the internal region 104 of the housing 102. Each arm 814 separates the openings 805 from one another. The peripheral region 804 has an outermost dimension that is greater than an outermost dimension of the housing 102 and the aperture 12*a* in ceiling 12. The peripheral region 804 blocks visibility of the aperture 12*a* from the room in which the system 10 is connected. The central region 806 has an outermost dimension that is less than the outermost dimension of the peripheral region 804 and the outermost dimension of the housing 102.

The central region 806 of the adaptor 800 includes a central aperture 830 and a plurality of mount holes 832 as shown in FIGS. 19A-19D. The central aperture 830 is sized to receive both the central segment 450 of the bracket 412 and an extent of the power supply 1204. The mounting bracket 412 is arranged to couple to the central region 806 to mount the light fixture 1202 to the adaptor 800. The light fixture 1202 may then be secured to the mounting bracket 412 to provide the installed position P1. In the installed position P1, the central segment 450 and the upper portion of the power supply 1204 are positioned above the lower end wall of the central region 806 of the adaptor 800.

Figure 20D:
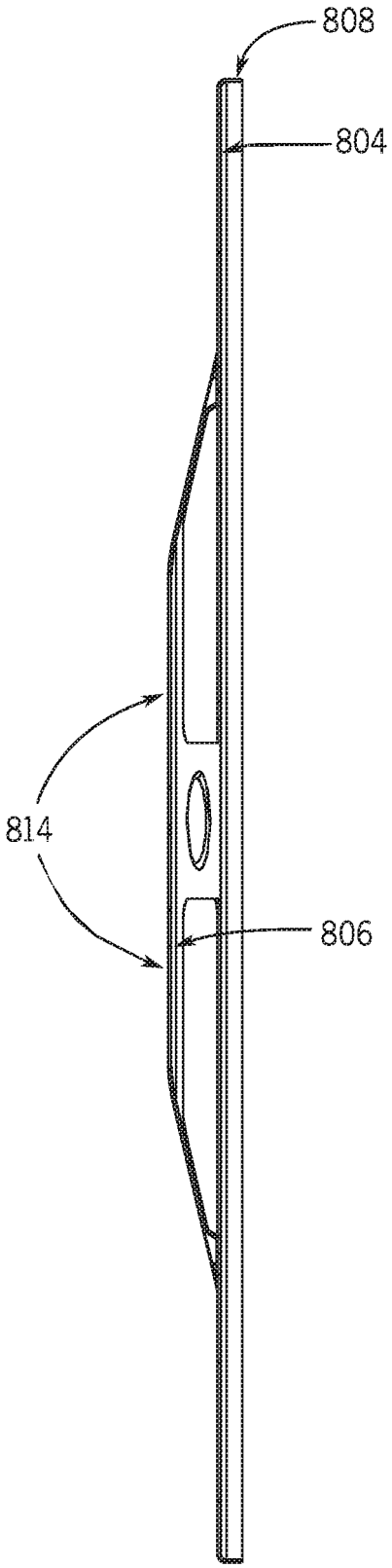
FIG. 20D is a cross sectional view of the adaptor taken along line 20D-20D in FIG. 20B.
Figure 20A:
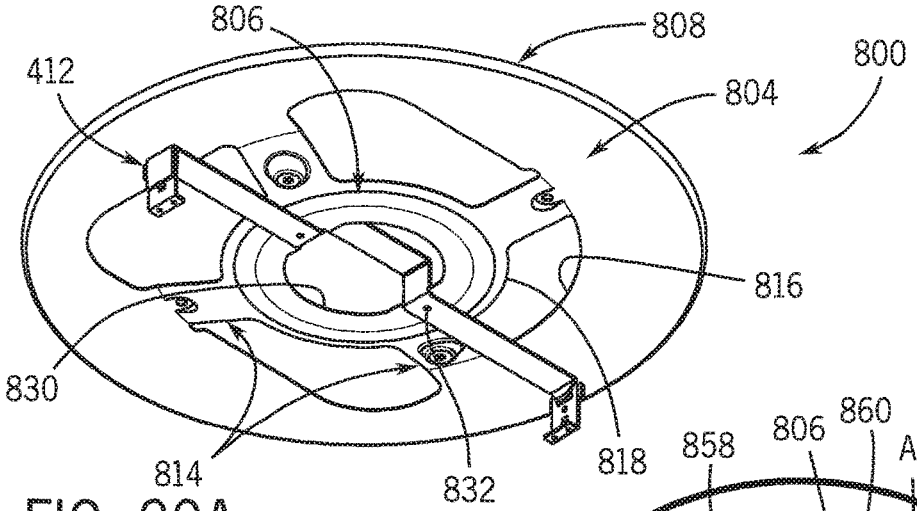
FIG. 20A is a bottom perspective view of a sixth embodiment of an adaptor, showing a mounting bracket affixed to the adaptor.
Figure 20B:
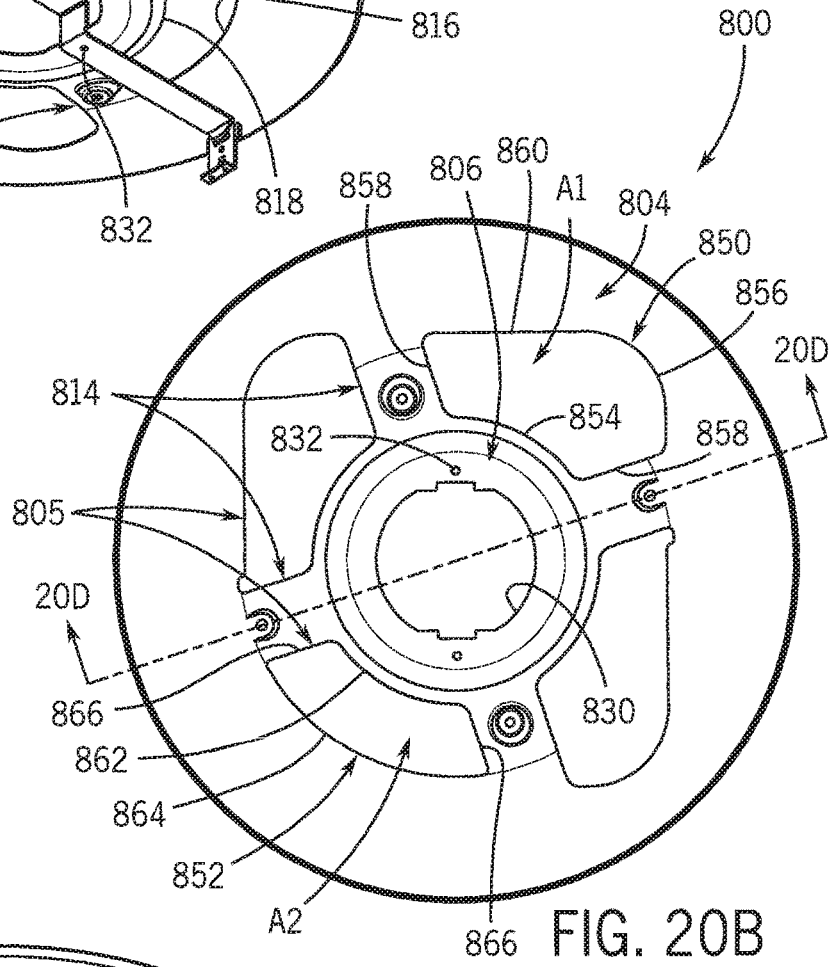
FIG. 20B is a bottom view of the adaptor of FIG. 20B without the mounting bracket.
Figure 20C:
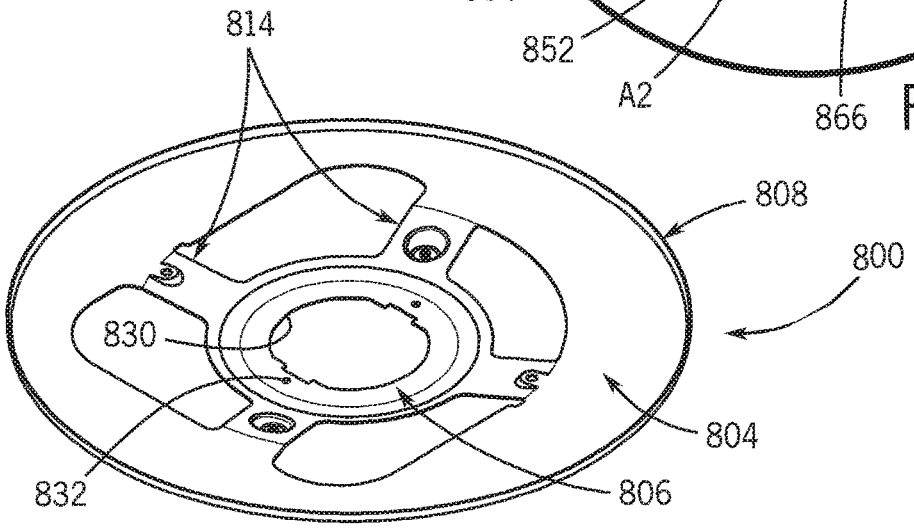
FIG. 20C is a top perspective view of the adaptor of FIG. 20A.

Unlike the openings 305, 405, the openings 805 are asymmetric and do not have the same opening area. The plurality of openings 805 are sized to allow a user or a technician to access the blower assembly and/or electrical systems contained within the internal region 104 of the housing 102 without removing the adaptor 800 from the housing 100. At least one of the openings 805 includes an area that is greater than the other openings 805. For example, as shown in FIG. 20B, a first opening 850 includes a larger periphery with a lobe region that provides the first opening 850 with a first opening area A1. A second opening 852 includes a lesser periphery defining a second opening area A2 that is smaller than the first opening area A1. In this way, the user may access the blower assembly or electrical systems in the internal region 104 of the housing 102 using the first opening 850 without disconnecting the adaptor 800 from the ventilation assembly 100.

Any suitable shape may be provided for the openings 805. In the illustrative embodiment, the first opening 850 includes an inner curvilinear edge 854 with a first cord length and an outer curvilinear edge 856 with a second cord length that is less than the first cord length. The first opening 850 further includes a pair of substantially linear side edges 858 and a substantially linear outer edge 860. The second opening 852 includes an inner curvilinear edge 862 with a third cord length that is about equal to the first cord length and an outer curvilinear edge 864 with a fourth cord length that is greater than the first, second and third cord lengths. The second opening 852 further includes a pair of substantially linear side edges 866.

Although adaptor 800 is shown in the Figures and described herein as being secured to mounting bracket 412, it should be noted that mounting bracket 312 may be secured to adaptor 800 to affix the light fixture to the adaptor 800. It is also noted that mounting bracket 412 may be secured to adaptor 700 to affix the light fixture to the adaptor 700.

Figure 21:
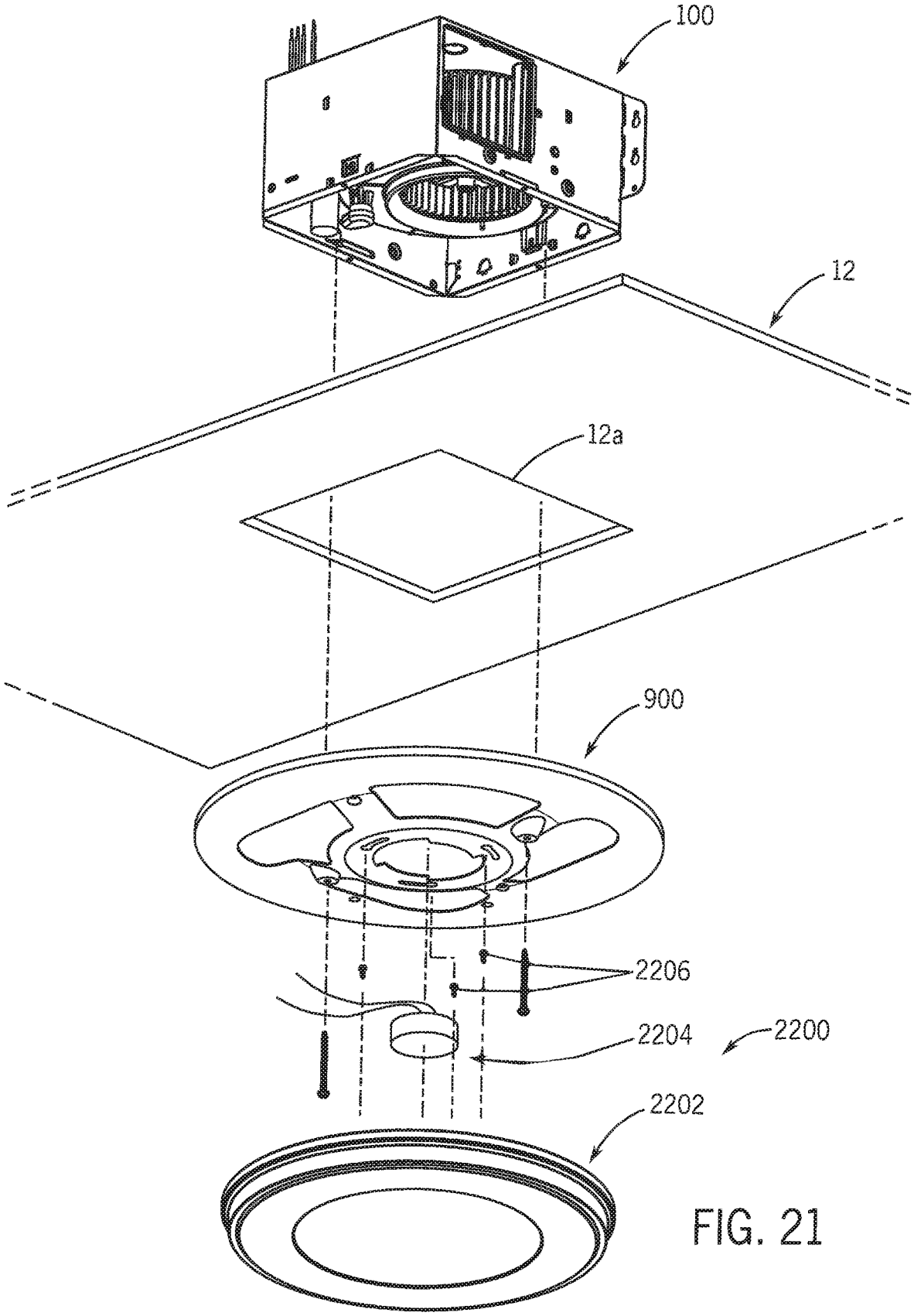
FIG. 21 is an exploded view of the ventilation and illumination system relative to a ceiling, the system including another embodiment of an adaptor configured to mount a light fixture to the ventilation assembly.
Figure 22A:
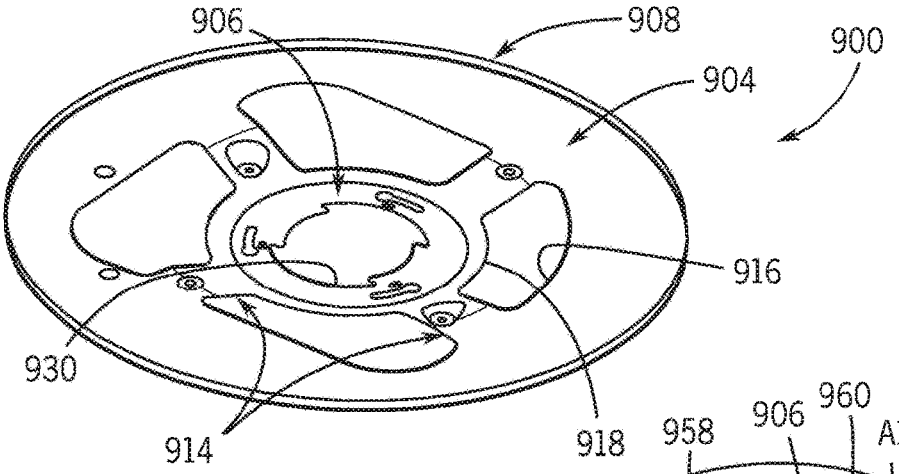
FIG. 22A is a bottom perspective view of the adaptor shown in FIG. 21.
Figure 22B:
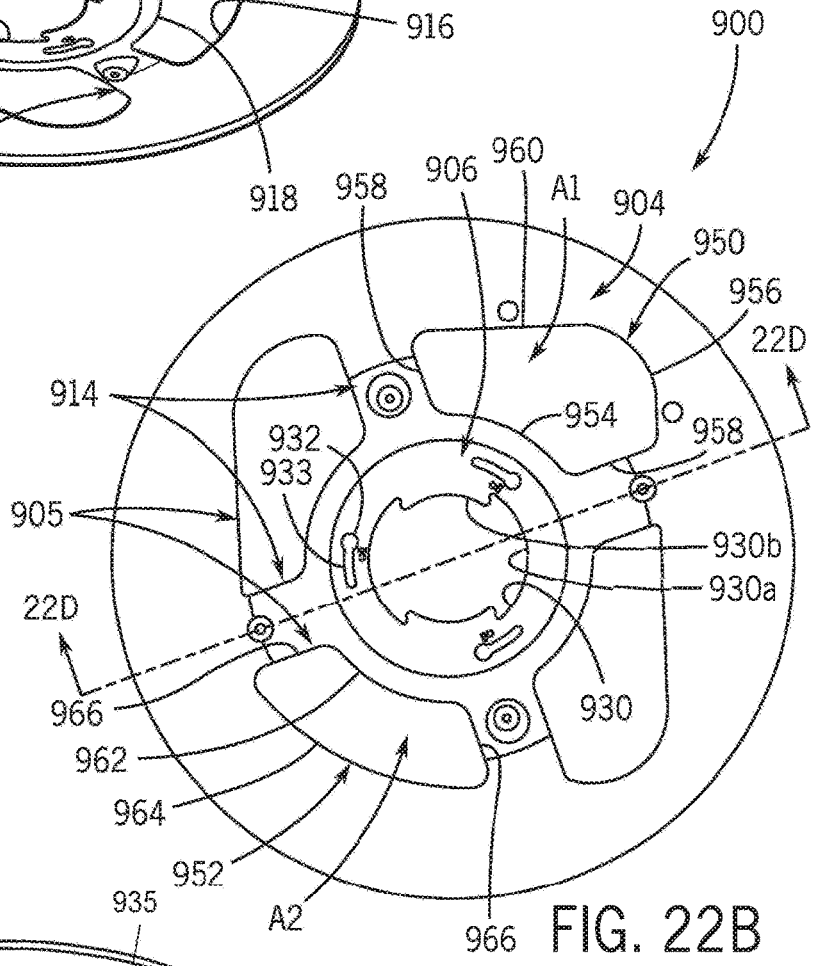
FIG. 22B is a bottom view of the adaptor of FIG. 21.
Figure 22C:
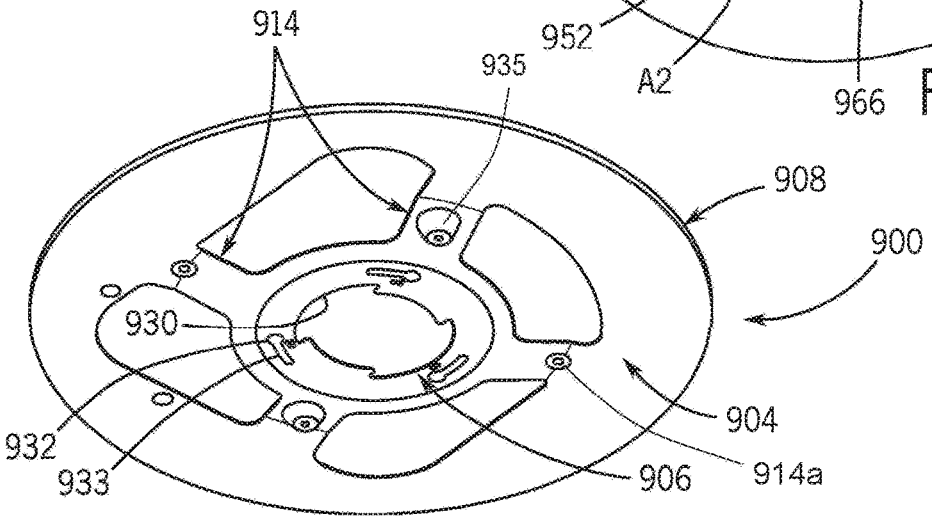
FIG. 22C is a top perspective view of the adaptor of FIG. 21.

FIGS. 21-22C illustrate another adaptor 900 for use in system 10, according to the present disclosure. The adaptor 900 shares many of the same elements and features described above with reference to the illustrated embodiment of adaptors 600 of FIGS. 17-18D and 800 of FIGS. 20A-20D. Similar reference numerals in the 900 series are used to describe like elements of the adaptor 900 as it compares to adaptors 600 and 800. The adaptor 900 is configured for use with ventilation assembly 100 and a light fixture assembly 2200 to mount the light fixture assembly 2200 to the ventilation assembly 100 while underlying and spanning the ceiling aperture 12*a* to obscure it from view by a person standing in the room in which the system 10 is installed.

Figure 22D:
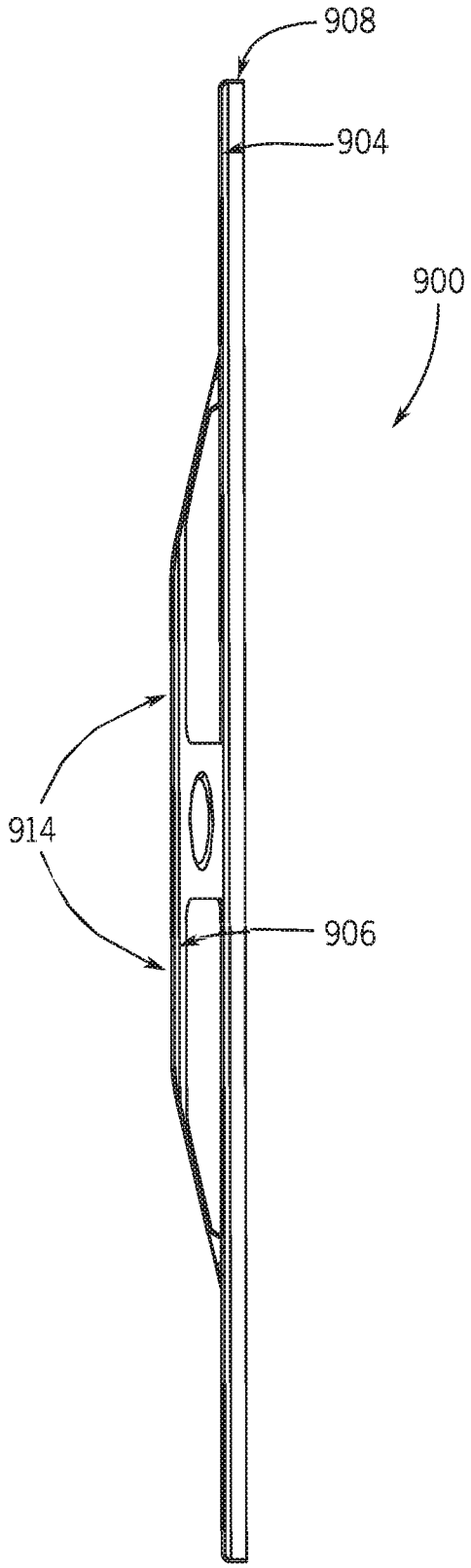
FIG. 22D is a cross sectional view of the adaptor taken along line 22D-22D in FIG. 22B.

The adaptor 900 provides the first critical distance 326 and the second critical distance 332, as discussed above. The adaptor 900 includes a peripheral region 904 and a central region 906 that is at least partially vertically offset from the peripheral region 904. The adaptor 900 also includes a peripheral flange 908 that provides the same function as peripheral flange 308. A plurality of arms 914 extend between the peripheral region 904 and the central region 906. Specifically, the arms 914 extend from an inner edge 916 of the peripheral region 904 and converge at an outer edge 918 of the central region 906. The plurality of arms 914 extend at a downward angle from the peripheral region 904 to vertically offset the central region 906 from the peripheral region 904, as shown in FIG. 22D. As a result, the adaptor 900 has an overall height of at least 0.5 inch, and preferably 0.75 inch, that ensures the first critical distance 326 without creating a first critical distance 326 that would provide an unappealing aesthetic appearance for the system 10. At least one arm 914 includes an aperture 914*a* that may be positioned within a recessed cavity and that receives a fastener, such as fastener 303 shown in FIG. 2, to couple the adaptor 900 to the housing 102.

At least one opening 905 is formed between the peripheral region 904 and the central region 906 to allow for air flow around the light fixture 2202 through the openings 905 and into the internal region 104 of the housing 102. Each arm 914 separates openings 905 from one another. The peripheral region 904 has an outermost dimension that is greater than an outermost dimension of the housing 102 and the aperture 12*a* in ceiling 12. The peripheral region 904 blocks visibility of the aperture 12*a* from the room in which the system 10 is connected. The central region 906 has an outermost dimension that is less than the outermost dimension of the peripheral region 904 and the outermost dimension of the housing 102.

The light fixture assembly 2200 includes a light fixture 2202 that is mounted to structures in a different manner compared to light fixtures 202 and 1202. The light fixture 2202 includes a plurality of mushroom head posts 2206 that are mounted to an upper surface of the light fixture 2202 and extend upwardly away from the light fixture 2202. Unlike adaptor 800, adaptor 900 includes features that allow for direct mounting of the light fixture assembly 2200 to the adaptor 900 without using one of the brackets 312, 412. In other words, the adaptor 900 is configured for direct mounting of the light fixture 2200 without usage of a bracket 312, 412 which further facilitates the low profile mounting of the light fixture 2200 provided by the system 10.

The central region 906 of the adaptor 900 includes a central aperture 930 that is sized to receive an extent of the power supply 2206. A plurality of mount holes 932 and corresponding elongated slots 933 are positioned circumferentially around the central aperture 930 as shown in FIGS. 22A-22C. The central aperture 930 has notched segments 930*a* and curvilinear segments 930*b* wherein the periphery of the aperture 930 has a jagged, non-curvilinear configuration. The mount holes 932 are sized slightly larger than the mushroom head posts 2206 to allow the mushroom head posts 2206 to extend there through when installing the light fixture 2202. The elongated slots 933 have a width that is slightly smaller than the mount posts 2202. With the mount posts 2206 positioned in the mount holes 932, the light fixture 2202 may be rotated relative to the adaptor 900 to move the mount posts 2202 into the elongated slots 933 and provide the installed position P1. The elongated slots 933 have a width that is slightly smaller than the mount posts 2202 so that at least a portion of the mount posts 2206 engage the central region 906 to retain the light fixture 2202 the adaptor 900 in the installed position P1. As shown in FIG. 22C, the adaptor 900 may also include one or more raised-mounting bosses 935 that are formed with an aperture and may receive an elongated fastener to mount a light fixture to the adaptor 900 or to mount the adaptor 900 to the ventilation assembly 100.

Due to its configuration, the adaptor 900 may be used with any type of light fixture, including the fixtures 200, 1200, 2200. It should be noted that any number of mount holes 932 and elongated slots 933 and corresponding posts 2206 may be used to mount the light fixture 2202 to the adaptor 900. It should also be noted that other suitable geometries for mount holes 932 and/or slots 933 may be formed in the adaptor 900 that correspond to other light fixtures so that the adaptor 900 is compatible with all types of light fixtures. Although adaptor 900 is shown in the Figures and described herein as being used without mounting brackets 312 and 412, it should also be noted that either of the mounting brackets 312, 412 may be secured to adaptor 900 to affix another type of light fixture to the adaptor 900.

As shown in FIGS. 22A-C, the openings 905 are asymmetric and do not have the same opening area. The plurality of openings 905 are sized to allow a user or a technician to access the blower assembly and/or electrical systems contained within the internal region 104 of the housing 102 without removing the adaptor 900 from the housing 100. At least one of the openings 905 includes an area that is greater than the other openings 905. For example, as shown in FIG. 22B, a first opening 950 includes a larger periphery with a lobe region that provides the first opening 950 with a first opening area A1. A second opening 952 includes a lesser periphery defining a second opening area A2 that is smaller than the first opening area A1. In this way, the user may access the blower assembly or electrical systems in the internal region 104 of the housing 102 using the first opening 950 without disconnecting the adaptor 900 from the ventilation assembly 100.

Any suitable shape may be provided for the openings 905. In the illustrative embodiment, the first opening 950 includes an inner curvilinear edge 954 with a first cord length and an outer curvilinear edge 956 with a second cord length that is less than the first cord length. The first opening 950 further includes a pair of substantially linear side edges 958 and a substantially linear outer edge 960. The second opening 952 includes an inner curvilinear edge 962 with a third cord length that is about equal to the first cord length and an outer curvilinear edge 964 with a fourth cord length that is greater than the first, second and third cord lengths. The second opening 952 further includes a pair of substantially linear side edges 966.

While preferred embodiments have been described above and illustrated in the accompanying drawings, it will be evident to those skilled in the art that modifications may be made without departing from this disclosure. Such modifications are considered as possible variants comprised in the scope of the disclosure. Headings and subheadings, if any, are used for convenience only and do not limit the disclosure. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The use of the terms "a" and "an" and "the" and "said" and similar references in the context of describing the disclosure (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

We claim:

1. A ventilation and illumination system installable within a ceiling of a building structure, the ventilation and illumination system comprising:

a ventilation assembly including (i) a main housing with an external wall arrangement defining an internal region of the housing, (ii) an inlet opening defined in the main housing and in fluid communication with the internal region, (iii) an outlet opening defined in the main housing and configured to allow air to flow from the main housing, and (iv) a blower residing within the internal region and configured to generate air flow through the inlet opening and into the main housing;

an adaptor configured to approximately span the inlet opening, the adaptor including (i) a peripheral region, (ii) a central region, (iii) a plurality of arms extending between the peripheral region and the central region, and, (iv) at least one opening formed between the arms that allows for the passage of air through the adaptor and into the inlet opening;

a light fixture coupled to the adaptor to define an installed position that provides a low-profile mounting configuration of the light fixture with respect to the ceiling;

a mounting bracket configured to couple to both the central region of the adaptor and the light fixture in the installed position, the mounting bracket defining a central aperture configured to receive an extent of a power supply for the light fixture in the installed position; and, wherein in the installed position, the light fixture is offset a first critical distance from the peripheral region of the adaptor to define an air flow gap that allows for air flow around the light fixture, through the opening in the adaptor and into the internal region of the main housing.

2. The integrated ventilation and illumination system of claim 1, wherein the first critical distance is sized according to operating parameters of the blower of the ventilation assembly to provide a sufficient flow rate of intake air and acceptable sound levels during operation of the ventilation and illumination system.

3. The integrated ventilation and illumination system of claim 1, wherein the first critical distance is less than 1 inch.

4. The ventilation and illumination system of claim 1, wherein the first critical distance is ¾ inch.

5. The ventilation and illumination system of claim 1, wherein the first critical distance is between ¼ and 1 inch.

6. The ventilation and illumination system of claim 1, wherein in the installed position, the inlet opening of the housing is aligned with an aperture formed in the ceiling, and the adaptor spans and obscures the ceiling aperture, and wherein the combination of the adaptor and the light fixture obscures the housing inlet opening and the ceiling aperture from view.

7. The ventilation and illumination system of claim 6, wherein in the installed position, the light fixture is offset a second critical distance from a lower surface of the ceiling to further define the air flow gap that allows for air flow around the light fixture, through the adaptor, and into the internal region of the main housing.

8. The ventilation and illumination system of claim 7, wherein the second critical distance exceeds the first critical distance.

9. The ventilation and illumination system of claim 1, wherein the peripheral region of the adaptor has a peripheral flange that engages an extent of a lower surface of the ceiling to define a clearance within the peripheral adaptor region to both accommodate a housing flange and block visibility of said housing flange when the ventilation assembly is offset mounted relative to the ceiling.

10. The ventilation and illumination system of claim 1, the mounting bracket having a staggered central segment that forms a receptacle, and in the installed position, the staggered central segment and a power supply for the light fixture extend through a central aperture of the adaptor.

11. A ventilation and illumination system installable within a ceiling of a building structure, the ventilation and illumination system comprising:

a ventilation assembly including (i) a main housing defining an internal region of the housing, (ii) an inlet opening defined in the main housing and in fluid communication with the internal region and an aperture formed in the ceiling, (iii) an outlet opening defined in the main housing and configured to allow air to flow from the main housing, and (iv) a blower residing within the internal region and configured to generate air flow through both the ceiling aperture and the inlet opening and then into the internal region of the housing;

an adaptor configured to underlie both the ceiling aperture and the inlet opening, the adaptor including (i) a peripheral region, (ii) a plurality of arms extending inward from the peripheral region, and, (iii) at least one opening formed between the arms that allows for the passage of air through the adaptor and into the inlet opening;

a light fixture coupled to the adaptor to define an installed position;

a mounting bracket configured to couple to both the central region of the adaptor and the light fixture in the installed position, the mounting bracket having a staggered central segment that forms a receptacle, wherein the staggered central segment and a power supply for the light fixture extend through a central aperture of the adaptor in the installed position; and, wherein in the installed position, the light fixture is offset a first critical distance from the peripheral region of the adaptor to define an air flow gap that allows for air flow around the light fixture, through the opening in the adaptor and into the internal region of the main housing, and wherein the first critical distance is sized according to operating parameters of the blower of the ventilation assembly to provide a sufficient flow rate of intake air and acceptable sound levels during operation of the ventilation and illumination system.

12. The integrated ventilation and illumination system of claim 11, wherein the first critical distance is less than 1 inch.

13. The ventilation and illumination system of claim 11, wherein the first critical distance is ¾ inch.

14. The ventilation and illumination system of claim 11, wherein the first critical distance is between ¼ and 1 inch.

15. The ventilation and illumination system of claim 11, wherein in the installed position, the inlet opening of the housing is aligned with an aperture formed in the ceiling, and the adaptor underlies and obscures the ceiling aperture, and wherein the combination of the adaptor and the light fixture obscures the housing inlet opening and the ceiling aperture from view.

16. The ventilation and illumination system of claim 15, wherein in the installed position, the light fixture is offset a second critical distance from a lower surface of the ceiling to further define the air flow gap that allows for air flow around the light fixture, through the adaptor, and into the internal region of the main housing.

17. The ventilation and illumination system of claim 16, wherein the second critical distance exceeds the first critical distance.

18. The ventilation and illumination system of claim 11, wherein the peripheral region of the adaptor has a peripheral flange that engages an extent of a lower surface of the ceiling to define a clearance within the peripheral adaptor region to both accommodate a housing flange and block visibility of said housing flange when the ventilation assembly is offset mounted relative to the ceiling.

19. The ventilation and illumination system of claim 11, the mounting bracket having a central aperture that receives an extent of a power supply for the light fixture in the installed position.

20. A ventilation and illumination system installable within a ceiling of a building structure, the ventilation and illumination system comprising:

a ventilation assembly including (i) a main housing with an external wall arrangement defining an internal region of the housing, (ii) an inlet opening defined in the main housing and in fluid communication with the internal region, (iii) an outlet opening defined in the main housing and configured to allow air to flow from the main housing, and (iv) a blower residing within the internal region and configured to generate air flow through the inlet opening and into the main housing;

an adaptor configured to couple to the main housing or the ceiling, the adaptor including (i) a peripheral region, (ii) a central region, (iii) a plurality of arms extending between the peripheral region and the central region, and, (iv) at least one opening formed between the arms that allows for the passage of air through the adaptor and into the inlet opening;

a light fixture configured to couple to the adaptor to define an installed position that provides a low-profile mounting configuration of the light fixture with respect to the ceiling;

a mounting bracket having a staggered central segment that defines a receptacle, wherein, in the installed position, the mounting bracket is configured to couple to both the central region of the adaptor and the light fixture and the staggered central segment and a power supply for the light fixture extend through a central aperture of the adaptor; and, wherein in the installed position, the light fixture is offset a first critical distance from the peripheral region of the adaptor to define an air flow gap that allows for air flow around the light fixture, through the opening in the adaptor and into the internal region of the main housing.

* * * * *